US010434532B2

(12) United States Patent
Ophardt et al.

(10) Patent No.: US 10,434,532 B2
(45) Date of Patent: Oct. 8, 2019

(54) THREE PIECE PUMP

(71) Applicant: OP-Hygiene IP GmbH, Niederbipp (CH)

(72) Inventors: Heiner Ophardt, Arisdorf (CH); Andrew Jones, St. Anns (CA); Zhenchun Shi, Hamilton (CA)

(73) Assignee: OP-Hygiene IP GmbH, Niederbipp (CH)

( * ) Notice: Subject to any disclaimer, the term of this patent is extended or adjusted under 35 U.S.C. 154(b) by 196 days.

(21) Appl. No.: 15/458,630

(22) Filed: Mar. 14, 2017

(65) Prior Publication Data

US 2017/0266680 A1 Sep. 21, 2017

(30) Foreign Application Priority Data

Mar. 15, 2016 (CA) ..... 2923827

(51) Int. Cl.

| | |
|---|---|
| ***B05B 11/00*** | (2006.01) |
| ***B05B 7/00*** | (2006.01) |
| ***F04B 19/22*** | (2006.01) |
| ***F04B 23/02*** | (2006.01) |
| ***F04B 23/10*** | (2006.01) |
| ***F04B 45/04*** | (2006.01) |
| ***F04B 53/10*** | (2006.01) |

(52) U.S. Cl.

CPC ..... *B05B 11/3087* (2013.01); *B05B 7/0037* (2013.01); *B05B 11/001* (2013.01); *B05B 11/3028* (2013.01); *F04B 19/22* (2013.01); *F04B 23/02* (2013.01); *F04B 23/106* (2013.01); *F04B 45/04* (2013.01); *F04B 53/102* (2013.01); *B05B 11/0044* (2018.08); *B05B 11/3001* (2013.01)

(58) Field of Classification Search

CPC ..... B05B 11/3052; B05B 11/3035; B05B 11/3074; B05B 11/3077; B05B 11/3067; B05B 11/3073; B05B 11/3087; B05B 7/005; B05B 7/0037; A47K 5/14

USPC ..... 222/190, 321.7, 207, 209

See application file for complete search history.

(56) References Cited

U.S. PATENT DOCUMENTS

| | | | | |
|---|---|---|---|---|
| 3,987,938 | A * | 10/1976 | Cooprider | B05B 11/3032 222/209 |
| 5,271,530 | A | 12/1993 | Uehira et al. | |
| 5,363,993 | A * | 11/1994 | Mascitelli | B05B 11/0013 222/153.09 |
| 5,462,208 | A | 10/1995 | Stahley | |
| 5,664,703 | A * | 9/1997 | Reifenberger | B05B 11/0064 222/207 |
| 5,975,360 | A | 11/1999 | Ophardt | |
| 6,478,197 | B2 * | 11/2002 | Bethune | B05B 11/3042 222/321.7 |
| 7,337,930 | B2 | 3/2008 | Ophardt et al. | |

(Continued)

FOREIGN PATENT DOCUMENTS

| | | |
|---|---|---|
| CN | 105083730 | 11/2015 |
| JP | 2007137497 | 6/2007 |

*Primary Examiner* — Charles Cheyney

(74) *Attorney, Agent, or Firm* — Thorpe North and Western, LLP

(57) ABSTRACT

The present invention provides an improved pump assembly incorporating a liquid pump and an air pump and which pump includes a flexible annular diaphragm member coaxially about a piston-forming element forming a component with the liquid pump.

22 Claims, 12 Drawing Sheets

(56) References Cited

U.S. PATENT DOCUMENTS

| | | | | |
|---|---|---|---|---|
| 8,297,475 | B2 * | 10/2012 | Limbert | B05B 11/3087 222/153.07 |
| 8,814,005 | B2 * | 8/2014 | Banks | B01F 5/0478 222/190 |
| 2004/0149777 | A1 | 8/2004 | Santagiuliana | |
| 2010/0200615 | A1 | 8/2010 | Ciavarella | |

* cited by examiner

THREE PIECE PUMP

SCOPE OF THE INVENTION

This invention relates to a pump for simultaneous discharge of liquid and air and, more particularly, to a pump assembly including a liquid pump and an air pump in which the air pump comprises a flexible annular diaphragm member coaxially about a piston-forming element of the liquid pump.

BACKGROUND OF THE INVENTION

Pumps are known for the simultaneous discharge of a liquid from a reservoir bottle and air from the atmosphere. One example of such a pump is U.S. Pat. No. 5,271,530 to Uehira et al, issued Dec. 21, 1993. The inventors of the present invention have appreciated that such previously known pumps suffer the disadvantages that they are formed from a large number of parts, and are complex in their manufacture of the different parts leading to increased costs for manufacture and assembly.

The present inventors have appreciated that pumps are known which use diaphragm members, however, it is appreciated that disadvantages arise in respect of the construction of known diaphragm members so as to facilitate their manufacture and advantageous sealing engagement with other elements of the pumps.

SUMMARY OF THE INVENTION

To at least partially overcome some of these disadvantages of the previously known devices, the present invention provides an improved pump assembly incorporating a liquid pump and an air pump and which pump includes a flexible annular diaphragm member coaxially about a piston-forming element forming a component with the liquid pump.

To at least partially overcome other disadvantages of the previously known devices, the present invention provides a novel arrangement whereby an annular end of a flexible annular diaphragm member of a pump may engage with an annular seat arrangement, preferably providing a relief valve therebetween to open and close a passageway.

In one aspect, the present invention provides a pump assembly having a liquid pump comprising a piston-forming element reciprocally axially slidable in a piston liquid chamber-forming body to discharge a liquid from a non-collapsible reservoir and an air pump comprising a flexible annular diaphragm member coaxially about the piston-forming element spanning between the piston-forming element and the piston chamber-forming body for simultaneous discharge of air by the air piston with the discharge of liquid by the liquid piston and in which the diaphragm member engages the piston chamber-forming body to form an air relief valve which open and closes with movement of the diaphragm member to permit external atmosphere air to relieve any vacuum which may arise in the reservoir.

In another aspect, the present invention provides a foaming pump having a liquid pump comprising a piston-forming element reciprocally axially slidable in a piston liquid chamber-forming body between a retracted position and an extended position defining a liquid compartment therebetween having a variable volume;

an air pump comprising a flexible annular diaphragm member coaxially about the piston-forming element spanning between an axially outer piston end of the piston-forming element and the piston chamber-forming body to define a variable volume annular air compartment therebetween having a variable volume;

a non-collapsible reservoir having an interior containing a fluid to be dispensed, the interior enclosed but for having an outlet port, the piston liquid chamber-forming body closing the outlet port, a liquid inlet through the piston liquid chamber-forming body from the interior of the reservoir to the liquid pump, an air relief passageway through the piston liquid chamber-forming body providing communication between external atmospheric air and the interior of the reservoir, in which:

(a) in the piston-forming element retracting in a retraction stroke to simultaneously force air from the air compartment and liquid from the liquid compartment internally through an internal passageway of the piston-forming element and through a foam generator to produce a foam of the air and the liquid and deliver the foam from a dispensing outlet carried on the piston-forming element, and b) in the piston-forming element extending in an extension stroke to simultaneously draw the atmospheric air into the air compartment and the liquid from the interior of the reservoir into the liquid compartment via the liquid inlet, the diaphragm member engaging the piston liquid chamber-forming body to form therebetween an air relief valve across the air relief passageway to open and to close the air relief passageway dependent on the relative axial position of the piston-forming element and the liquid chamber-forming body.

Preferably, an annular first end of the diaphragm member engages with an annular seat arrangement of the piston chamber-forming body annularly about the piston-forming element for limited reciprocal axial movement of the first end of the diaphragm member relative the annular seat arrangement between an axially inner position and an axially outer position;

the first end of the diaphragm member having a resilient positioning spring member engaging with the annular seat arrangement of the piston chamber-forming body to bias the first end of the diaphragm member from the inner position toward the outer position;

the first end of the diaphragm member having a sealing member engaging the annular seat arrangement of the piston chamber-forming body to form an annular seal preventing flow into and out of the annular air compartment between the sealing member and the annular seat arrangement of the piston chamber-forming body in all positions of the first end of the diaphragm member and the annular seat arrangement between the inner position and the outer position;

the first end of the diaphragm member having an air relief valve member interacting with an air relief valve seat surface of the annular seat arrangement of the piston chamber-forming body to close and to open the air relief passageway dependent on the axial position of the first end of the diaphragm member relative the annular seat arrangement between the inner position and the outer position.

As a $1^{st}$ feature, the present invention provides a foaming pump having:

a liquid pump comprising a piston-forming element reciprocally axially slidable in a piston liquid chamber-forming body between a retracted position and an extended position defining a liquid compartment therebetween having a variable volume;

an air pump comprising a flexible annular diaphragm member coaxially about the piston-forming element spanning between an axially outer piston end of the piston-forming element and the piston chamber-forming body to define a variable volume annular air compartment therebetween having a variable volume;

a non-collapsible reservoir having an interior containing a fluid to be dispensed, the interior enclosed but for having an outlet port, the piston liquid chamber-forming body closing the outlet port, a liquid inlet through the piston liquid chamber-forming body from the interior of the reservoir to the liquid pump, an air relief passageway through the piston liquid chamber-forming body providing communication between external atmospheric air and the interior of the reservoir, in which:

(a) in the piston-forming element retracting in a retraction stroke to simultaneously force air from the air compartment and liquid from the liquid compartment internally through an internal passageway of the piston-forming element and through a foam generator to produce a foam of the air and the liquid and deliver the foam from a dispensing outlet carried on the piston-forming element, and (b) in the piston-forming element extending in an extension stroke to simultaneously draw the atmospheric air into the air compartment and the liquid from the interior of the reservoir into the liquid compartment via the liquid inlet, the diaphragm member engaging the piston liquid chamber-forming body to form therebetween an air relief valve across the air relief passageway to open and to close the air relief passageway dependent on the relative axial position of the piston-forming element and the liquid chamber-forming body.

As a $2^{nd}$ feature, the present invention provides a foaming pump as claimed in the $1^{st}$ feature wherein:

an annular first end of the diaphragm member engages with an annular seat arrangement of the piston chamber-forming body annularly about the piston-forming element for limited reciprocal axial movement of the first end of the diaphragm member relative the annular seat arrangement between an axially inner position and an axially outer position;

the first end of the diaphragm member having a resilient positioning spring member engaging with the annular seat arrangement of the piston chamber-forming body to bias the first end of the diaphragm member from the inner position toward the outer position;

the first end of the diaphragm member having a sealing member engaging the annular seat arrangement of the piston chamber-forming body to form an annular seal preventing flow into and out of the annular air compartment between the sealing member and the annular seat arrangement of the piston chamber-forming body in all positions of the first end of the diaphragm member and the annular seat arrangement between the inner position and the outer position;

the first end of the diaphragm member having an air relief valve member interacting with an air relief valve seat surface of the annular seat arrangement of the piston chamber-forming body to close and to open the air relief passageway dependent on the axial position of the first end of the diaphragm member relative the annular seat arrangement between the inner position and the outer position.

As a $3^{rd}$ feature, the present invention provides a foaming pump as claimed in the $2^{nd}$ feature wherein the first end of the diaphragm member is an annular axially inner distal end of the diaphragm member.

As a $4^{th}$ feature, the present invention provides a foaming pump as claimed in the $2^{nd}$ or $3^{rd}$ feature wherein in a first position selected from the inner position and the outer position, the air relief valve member engages the air relief valve seat surface of the annular seat arrangement of the piston chamber-forming body to close the air relief passageway and, in a second position, different than the first position and also selected from the inner position and the outer position, the air relief valve member is located relative the air relief valve seat surface of the annular seat arrangement of the piston chamber-forming body to open the air relief passageway.

As a $5^{th}$ feature, the present invention provides a foaming pump as claimed in any one of the $2^{nd}$ to $4^{th}$ features including a piston spring member biasing the piston-forming element to the extended position relative the piston chamber-forming body, and the diaphragm member deflectable between an expanded condition in which the piston-forming element is in the extended position relative the piston chamber-forming body and a compressed condition in which the piston-forming element is in the retracted position relative the piston chamber forming, the volume of the air compartment is greater when the diaphragm member is in the expanded condition than when the diaphragm member is in the compressed condition.

As a $6^{th}$ feature, the present invention provides a foaming pump as claimed in the $5^{th}$ feature wherein the diaphragm member having an inherent bias to assume the expanded condition and the inherent bias urges the diaphragm member to return toward the expanded condition when the diaphragm member is moved from the expanded condition toward the compressed condition.

As a $7^{th}$ feature, the present invention provides a foaming pump as claimed in the $6^{th}$ feature wherein the diaphragm member comprises the piston spring member.

As an $8^{th}$ feature, the present invention provides a foaming pump as claimed in any one of the $5^{th}$ to $7^{th}$ features wherein the piston spring member biasing the piston-forming element to the extended position urges the first end of the diaphragm member toward the inner position and when the piston-forming element is in the extended position, the inherent bias of the positioning spring member moves the first end of the diaphragm member to the outer position.

As a $9^{th}$ feature, the present invention provides a foaming pump as claimed in any one of the $5^{th}$ to $8^{th}$ features wherein the piston spring member urges the first end of the diaphragm member toward the inner position in opposition to the positioning spring member which urges the first end of the diaphragm member toward the outer position, and wherein when the piston-forming element is in the extended position, the positioning spring member overcomes the piston spring member and moves the first end of the diaphragm member to the outer position.

As a $10^{th}$ feature, the present invention provides a foaming pump as claimed in any one of the $1^{st}$ to $9^{th}$ features wherein:

the diaphragm member having an annular flexible diaphragm side wall extending from a first side wall end at the first end of the diaphragm member to a second side wall end, the diaphragm side wall coaxially disposed about the piston-forming member with the second side wall end of the diaphragm side wall sealably coupled to the outer piston end of the piston-forming element for movement therewith and the first side wall end of the diaphragm side wall coupled to the piston chamber-forming body to define the annular air chamber coaxially about the piston-forming element.

As an $11^{th}$ feature, the present invention provides a foaming pump as claimed in the $10^{th}$ feature wherein the diaphragm side wall extends axially from the first side wall end to the second side wall end.

As a 12$^{th}$ feature, the present invention provides a foaming pump as claimed in the 11$^{th}$ feature wherein the diaphragm side wall extends axially outwardly from the first side wall end to the second side wall end.

As a 13$^{th}$ feature, the present invention provides a foaming pump as claimed in the 10$^{th}$, 11$^{th}$ or 12$^{th}$ feature wherein the diaphragm side wall extends radially inwardly from the first side wall end to the second side wall end.

As a 14$^{th}$ feature, the present invention provides a foaming pump as claimed in any one of the 1$^{st}$ to 13$^{th}$ features wherein the diaphragm member has a central bore coaxially therethrough coaxially within the second side wall end of the diaphragm side wall, the outer piston end of the piston-forming element coaxially sealably engaged in the central bore.

As a 15$^{th}$ feature, the present invention provides a foaming pump as claimed in the 14$^{th}$ feature wherein the diaphragm member carries radially inwardly on the second side wall end of the diaphragm side wall a central tube coaxially with the diaphragm side wall and providing the central bore therethrough, the outer piston end of the piston-forming element coaxially sealably engaged in the central bore.

As a 16$^{th}$ feature, the present invention provides a foaming pump as claimed in the 14$^{th}$ or 15$^{th}$ feature wherein the central bore having a bore inlet and a bore outlet leading to the dispensing outlet, the outer piston end of the piston-forming element coaxially sealably engaged in the central bore with the internal passageway opening into the central bore.

As a 17$^{th}$ feature, the present invention provides a foaming pump as claimed in the 16$^{th}$ feature wherein the bore outlet is the dispensing outlet.

As a 18$^{th}$ feature, the present invention provides a foaming pump as claimed in the 16$^{th}$ feature wherein the diaphragm member includes a discharge tube with a discharge passageway open to the bore outlet at a first end and extending radially outwardly from the first end to a second end comprising the dispensing outlet.

As a 19$^{th}$ feature, the present invention provides a foaming pump as claimed in any one of the 1$^{st}$ to 18$^{th}$ features wherein the diaphragm member comprises an integral member of elastomeric material formed by injection molding.

As a 20$^{th}$ feature, the present invention provides a foaming pump as claimed in any one of the 1$^{st}$ to 19$^{th}$ features wherein the piston chamber-forming body comprises an integral member formed by injection molding.

As a 21$^{st}$ feature, the present invention provides a foaming pump as claimed in any one of the 1$^{st}$ to 20$^{th}$ features wherein the piston-forming element comprises an integral member formed by injection molding As a 22$^{nd}$ feature, the present invention provides a foaming pump as claimed in any one of the 1$^{st}$ to 18$^{th}$ features wherein the foaming pump other than the reservoir and the foam generator consists of:

a. the diaphragm member of elastomeric material formed integrally as a unitary integral element by injection molding, b. the piston chamber-forming body formed integrally as a unitary integral element by injection molding, and c. the piston-forming element formed integrally as a unitary integral element by injection molding.

As a 23$^{rd}$ feature, the present invention provides a foaming pump as claimed in any one of the 1$^{st}$ to 22$^{nd}$ features wherein:

a fluid chamber defined within the piston chamber-forming body coaxially about a central axis, the fluid chamber open at an axially outer chamber end, the piston-forming element having an axially inner piston end, the piston-forming element received in the fluid chamber with the inner piston end within the fluid chamber and the outer piston end extending axially out the open outer chamber end.

As a 24$^{th}$ feature, the present invention provides a foaming pump as claimed in the 23$^{rd}$ feature wherein the volume of the annular air chamber defined between the piston chamber-forming body, the diaphragm side wall and the piston-forming element radially outwardly of the piston-forming element where the piston-forming element extends from the open outer chamber end of the fluid chamber.

As a 25$^{th}$ feature, the present invention provides a foaming pump as claimed in the 23$^{rd}$ or 24$^{th}$ feature wherein the liquid inlet is provided at an axially inner end of the fluid chamber.

As a 26$^{th}$ feature, the present invention provides a foaming pump as claimed in any one of the 23$^{rd}$ to 25$^{th}$ features wherein the piston chamber-forming body having an inner end and an outer end, the fluid chamber extending inwardly from the inner end of the piston chamber-forming body, and the first end of the diaphragm member engages with the piston chamber-forming body coaxially radially outwardly about the outer chamber end.

As a 27$^{th}$ feature, the present invention provides a foaming pump as claimed in any one of the 23$^{rd}$ to 26$^{th}$ features wherein the piston-forming element having a central stem extending along the axis from the inner piston end to the outer piston end, the internal passageway axially through the stem to open at the piston outer end to the dispensing outlet.

As a 28$^{th}$ feature, the present invention provides a foaming pump as claimed in any one of the 1$^{st}$ to 27$^{th}$ features including an air port radially through the piston-forming element from the annular air compartment into the internal passageway of the piston-forming element.

As a 29$^{th}$ feature, the present invention provides a foaming pump as claimed in the 28$^{th}$ feature wherein in the piston-forming element in moving toward the retracted position, the air from the air compartment is forced through the air port into the internal passageway of the piston-forming element.

As a 30$^{th}$ feature, the present invention provides a foaming pump as claimed in the 28$^{th}$ or 29$^{th}$ feature wherein in the piston-forming element in moving toward the extended position, the atmospheric air is drawn into the air compartment via the dispensing outlet, the internal passageway and the air port.

As a 31$^{st}$ feature, the present invention provides a foaming pump as claimed in any one of the 1$^{st}$ to 30$^{th}$ features wherein the air and the liquid are forced upwardly through the internal passageway to the dispensing outlet.

As a 32$^{nd}$ feature, the present invention provides a foaming pump as claimed in any one of the 1$^{st}$ to 31$^{st}$ features wherein the piston liquid chamber-forming body orientated such that the piston-forming element is reciprocally axially slidable vertically relative the piston liquid chamber-forming body.

As a 33$^{rd}$ feature, the present invention provides a foaming pump as claimed in any one of the 1$^{st}$ to 32$^{nd}$ features including a dip tube extending downwardly through the interior of the reservoir providing for communication of liquid from the reservoir to the liquid pump via the liquid inlet.

As a 34$^{th}$ feature, the present invention provides a foaming pump as claimed in any one of the 1$^{st}$ to 33$^{rd}$ features wherein reservoir is disposed with its outlet port opening upwardly.

As a 35$^{th}$ feature, the present invention provides a foaming pump as claimed in the 2$^{nd}$ feature wherein the annular seat arrangement including an axially outwardly directed stop surface and an axially inwardly directed stop surface are opposed to the axially outwardly directed stop surface and spaced axially from the axially outwardly directed stop surface a first axial distance, the first end of the diaphragm member having an axially outwardly directed stop surface opposed to the axially inwardly directed stop surface of the annular seat arrangement and an axially inwardly directed stop surface opposed to the axially outwardly directed stop surface of the annular seat arrangement and spaced axially from the axially outwardly directed stop surface of the annular seat arrangement a second distance less than the first axial distance, engagement between the axially outwardly directed stop surface on the annular seat arrangement and the axially inwardly directed stop surface on the first end of the diaphragm member limits movement of the first end of the diaphragm member relative the annular seat arrangement in the inner position; and engagement between the axially inwardly directed stop surface on the annular seat arrangement and the axially outwardly directed stop surface on the first end of the diaphragm member limits movement of the inner end of the diaphragm member relative the annular seat arrangement in the outer position.

As a 36$^{th}$ feature, the present invention provides a foaming pump as claimed in the 2$^{nd}$ or 35$^{th}$ feature wherein:

the annular seat arrangement including an axially outwardly directed annular sealing seat surface, the sealing member comprising an annular sealing disc having an axially outer end fixed to the first end of the diaphragm member, the annular sealing disc extending axially inwardly from the axially outer end to an annular axially inner distal end of the annular sealing disc, the annular sealing disc being resilient and having an inherent bias urging the distal end of the annular sealing disc into sealed engagement with the axially outwardly directed annular sealing seat surface to form the annular seal preventing air flow between the sealing member and the axially outwardly directed annular sealing seat surface in all positions of the first end of the diaphragm member and the annular seat arrangement between the axially inner position and the axially outer position.

As a 37$^{th}$ feature, the present invention provides a foaming pump as claimed in the 36$^{th}$ feature wherein the annular sealing disc extends radially as it extends axially inwardly from the axially outer end to an annular axially inner distal end.

As a 38$^{th}$ feature, the present invention provides a foaming pump as claimed in the 37$^{th}$ feature wherein the annular sealing disc extends radially inwardly as it extends axially inwardly from the axially outer end to an annular axially inner distal end.

As a 39$^{th}$ feature, the present invention provides a foaming pump as claimed in the 38$^{th}$ feature wherein:

(i) in movement from the outer position to the inner position, the distal end of the annular sealing disc deflects radially inwardly against the inherent bias of the annular sealing disc with the annular axially inner distal end of the annular sealing disc sliding radially inwardly on the axially outwardly directed annular sealing seat surface in sealed engagement therewith, and (ii) in movement from the inner position to the outer position, urged by the inherent bias of the annular sealing disc, the distal end of the annular sealing disc deflects radially outwardly with the annular axially inner distal end of the annular sealing disc sliding radially outwardly on the axially outwardly directed annular sealing seat surface in sealed engagement therewith.

As a 40$^{th}$ feature, the present invention provides a foaming pump as claimed in the 36$^{th}$ to 38$^{th}$ features wherein under the inherent bias of the annular sealing disc, the annular axially inner distal end of the annular sealing disc engages the axially outwardly directed annular sealing seat surface to urge the first end of the diaphragm member axially outwardly away from the axially outwardly directed annular sealing seat surface.

As a 41$^{st}$ feature, the present invention provides a foaming pump as claimed in the 36$^{th}$ to 39$^{th}$ features wherein the resilient positioning spring member comprises the annular sealing disc.

As a 42$^{nd}$ feature, the present invention provides a foaming pump as claimed in the 2$^{nd}$ and 35$^{th}$ to 41$^{st}$ features wherein:

the air relief valve member comprising an annular valve disc having an axially outer end fixed to the first end of the diaphragm member, the annular valve disc extending axially inwardly from the axially outer end to an annular axially inner distal end of the annular valve disc, the annular valve disc extending radially outwardly as it extends axially inwardly, the air relief valve seat surface comprising an axially outwardly directed annular valve seat surface radially outwardly from the axially outwardly directed annular seating seat surface, (i) in movement from the outer position to the inner position, the distal end of the annular valve disc deflects against the inherent bias of the annular valve disc with the annular axially inner distal end of the annular valve disc sliding radially outwardly on the axially outwardly directed annular valve seat surface in sealed engagement therewith, and (ii) in movement from the inner position to the outer position, under the inherent bias of the annular valve disc, the distal end of the annular valve disc slides radially inwardly on the axially outwardly directed annular valve seat surface in sealed engagement therewith, the air relief passageway including:

(a) an inner portion through the piston liquid chamber-forming body providing communication from the interior of the reservoir to a first opening on the annular seat arrangement, (b) an outer portion providing communication between external atmospheric air and a second opening on the axially outwardly directed annular valve seat surface, and (c) an intermediate portion from the first opening to the second opening;

the first opening is radially outwardly of the annular seal and radially inwardly of the annular valve disc, in the outer position, the distal end of the annular valve disc is radially outwardly of the second opening and the sealed engagement of the distal end of the annular valve disc on the axially outwardly directed annular valve seat surface prevents communication through the intermediate portion between the first opening and the second opening, in the inner position, the distal end of the annular valve disc is radially inwardly of the second opening and the air is free to pass through the intermediate portion between the first opening to the second opening.

As a 43$^{rd}$ feature, the present invention provides a foaming pump as claimed in the 42$^{nd}$ feature wherein an annular air relief compartment is formed between the annular sealing disc and the annular valve disc enclosed but being open axially inwardly between the annular axially inner distal end of the annular valve disc and the annular axially inner distal end of the annular sealing disc, the annular seal preventing communication between the annular air compartment and the annular air relief compartment, the annular air relief compartment in communication with the first opening, in movement between the first position and the second position due to the radial sliding of the distal end of the annular valve disc movement to different radial positions on the axially outwardly directed annular valve seat surface, the annular air relief compartment is selectively placed into communication with the second opening and removed from communication with the second opening.

As a 44$^{th}$ feature, the present invention provides a foaming pump as claimed in the 43$^{rd}$ feature wherein the first opening is radially between the annular valve disc and the annular seal disc.

BRIEF DESCRIPTION OF THE DRAWINGS

Further aspects and advantages of the present invention will become apparent from the following description taken together with the accompanying drawings in which.

DETAILED DESCRIPTION OF THE DRAWINGS

Figure 1:
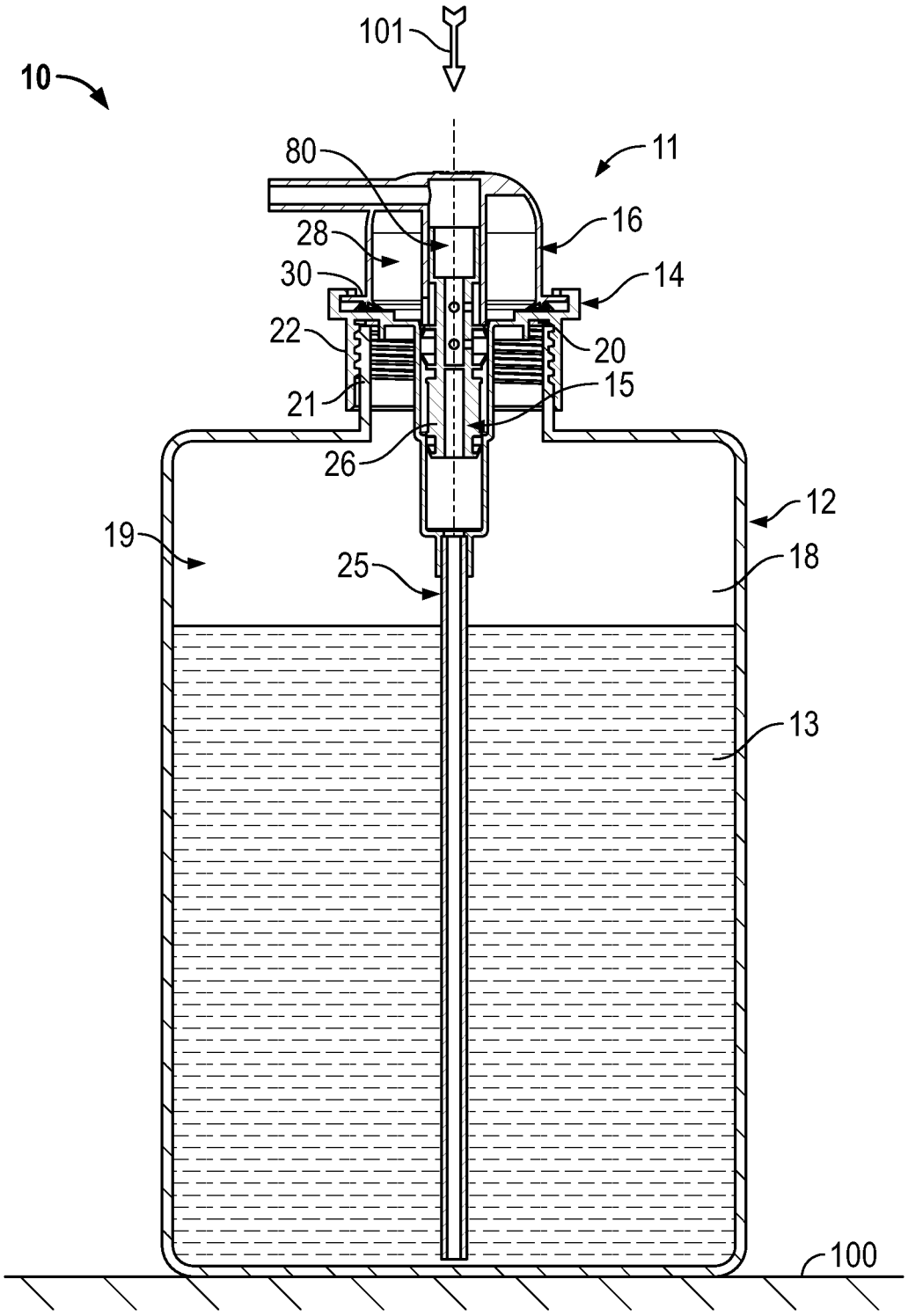
FIG. 1 is a cross-sectional side view of a foam dispenser in accordance with a first embodiment of the present invention.
Figure 2:
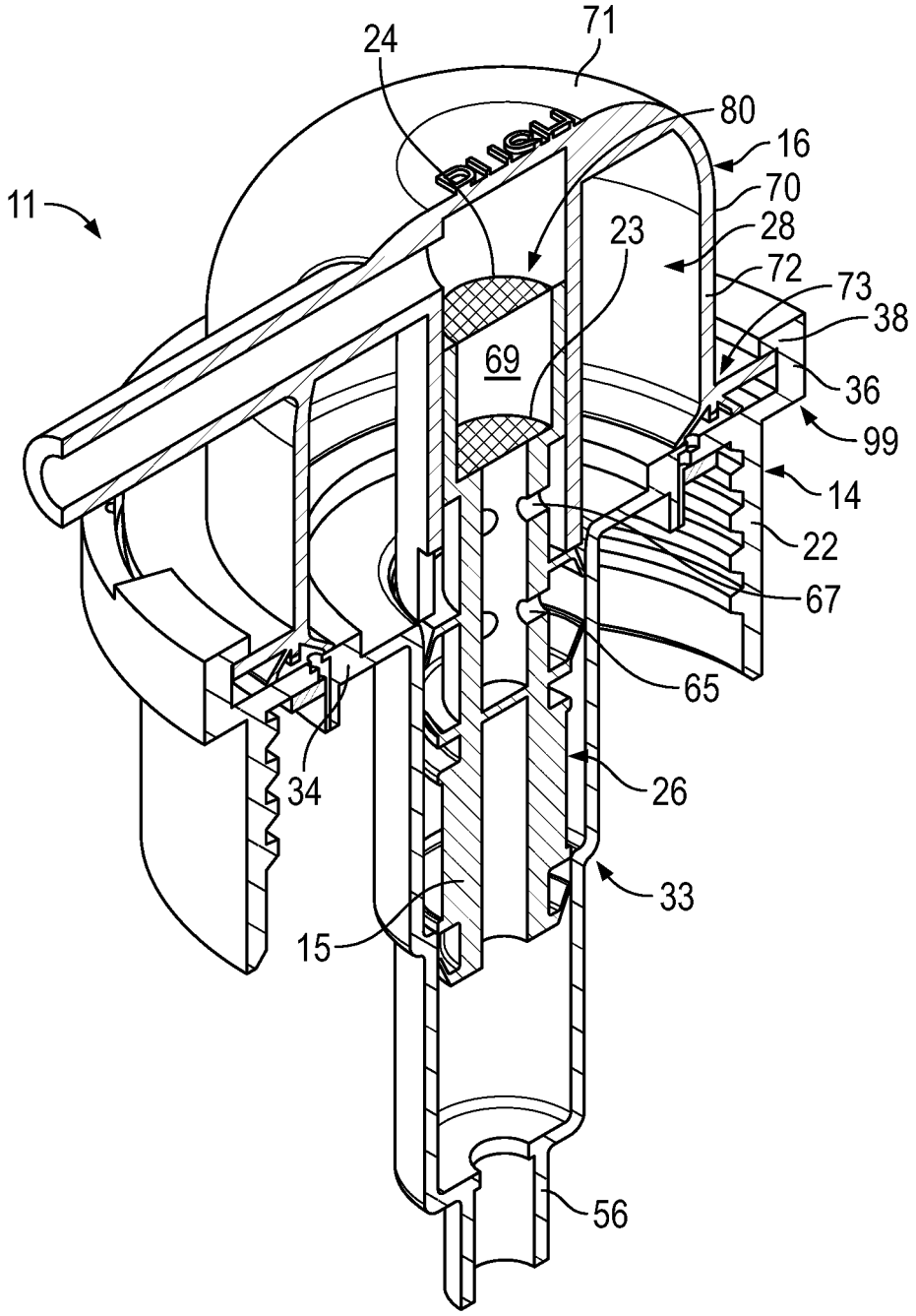
FIG. 2 is a cross-sectional pictorial view of the foaming pump assembly of the foam dispenser in FIG. 1 in an extended position.

Reference is made to FIG. 1 showing a foam dispenser 10 having a foaming pump assembly 11 secured to a reservoir 12 containing a foamable fluid 13 to be dispensed. The fluid 13 is preferably a liquid. The pump assembly 11 includes a piston chamber-forming body 14, a piston-forming element 15 and a diaphragm-forming component 16. As seen in FIG. 1, a dip tube 25 extends from the piston chamber-forming body 14 downwardly into the reservoir 12.

The reservoir 12 is a non-collapsible reservoir in the sense that as the fluid 13 is drawn from the reservoir 12 by operation of the pump assembly 11 with the discharge of the liquid 13 from the reservoir a vacuum comes to be developed within the reservoir as in the gas 18, being substantially air, in the reservoir 12 above the fluid 13.

The reservoir 12 defines an interior 19 with the interior 19 enclosed but for having an outlet port 20 formed in a cylindrical externally threaded neck 21 of the reservoir 12. The neck 21 of the reservoir 12 is sealably engaged on an internally threaded downwardly extending collar tube 22 on the piston chamber-forming body 14 with a preferred but optional resilient annular seal ring 22 (best seen in FIG. 3) axially compressed between the outlet port 20 and the piston chamber-forming body 14 to form a seal therebetween.

Figure 3:
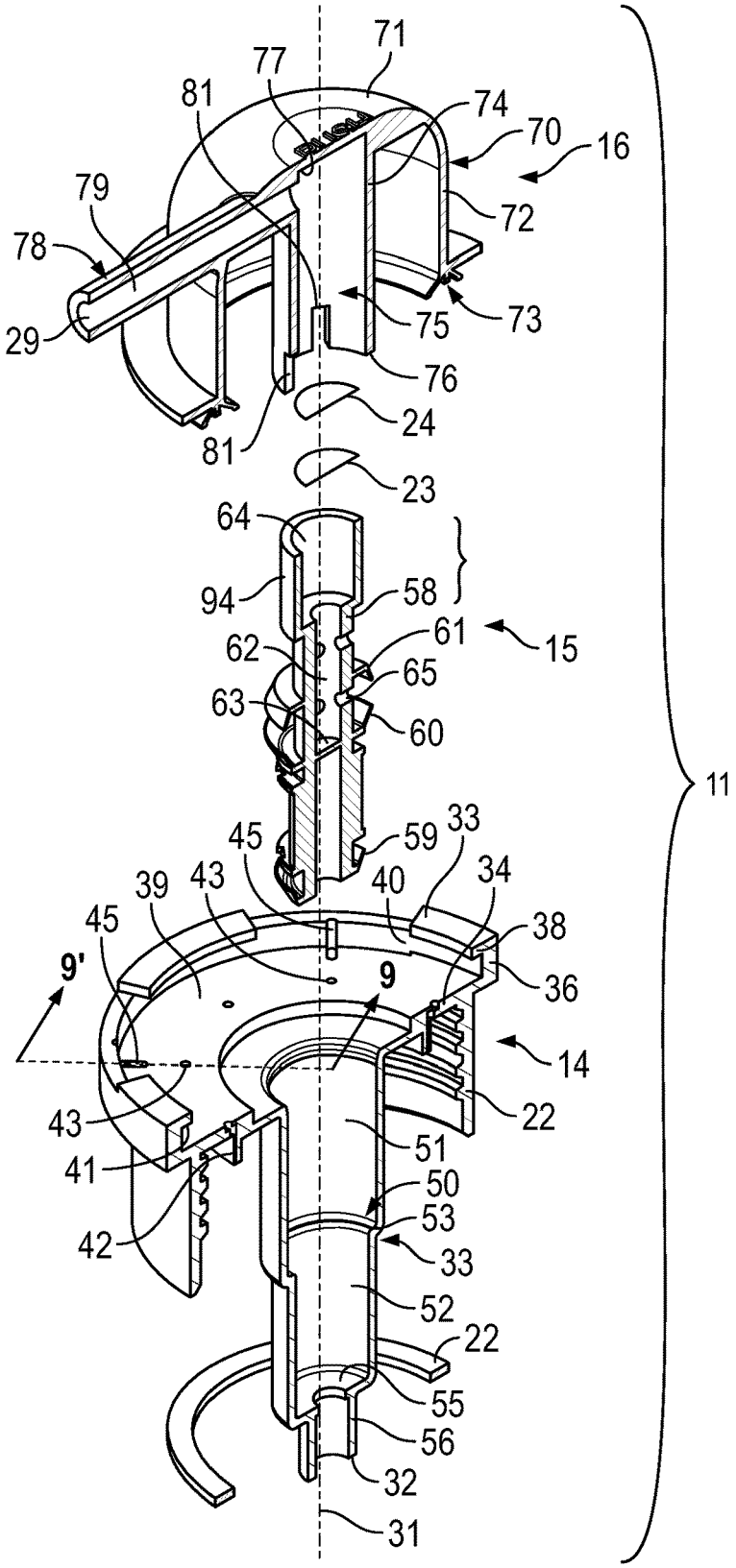
FIG. 3 is a cross-sectional exploded perspective view of the pump assembly of FIG. 2 as seen from above.
Figure 4:
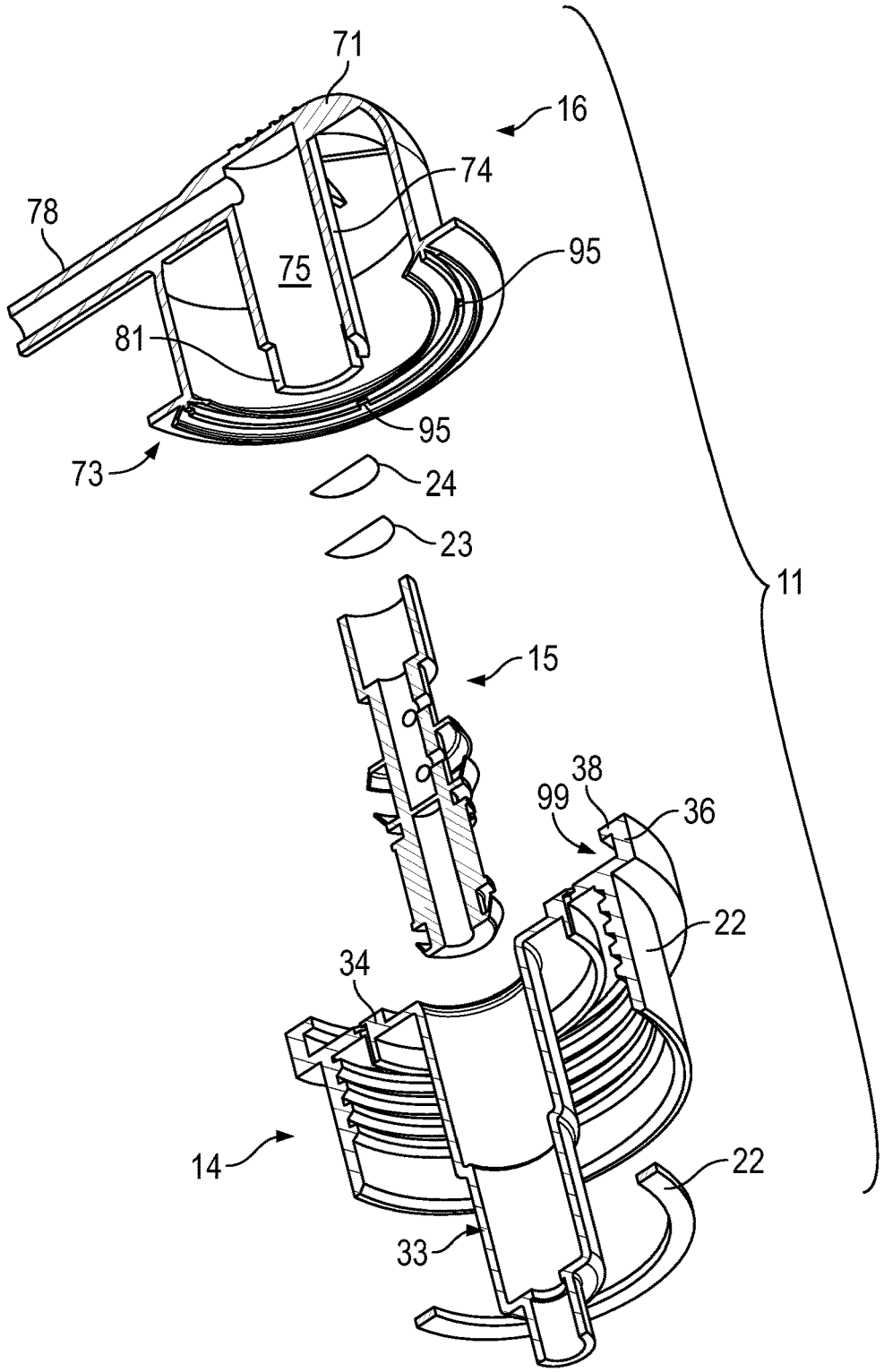
FIG. 4 is a cross-sectional exploded perspective view of the pump assembly of FIG. 2 as seen from below.

In the preferred embodiment as seen in FIGS. 3 and 4, each of the piston chamber-forming body 14, the piston-forming element 15 and the diaphragm-forming component 16 is formed as an integral element preferably by injection molding so as to provide the foaming pump assembly 11 from a minimal of parts. Aside from the major three elements, namely, the piston chamber-forming body 14, the piston-forming element 15 and the diaphragm-forming component 16, the pump assembly 11 has merely the dip tube 25, the optional seal ring 22 and a pair of foam inducing screens 23 and 24.

Figure 5:
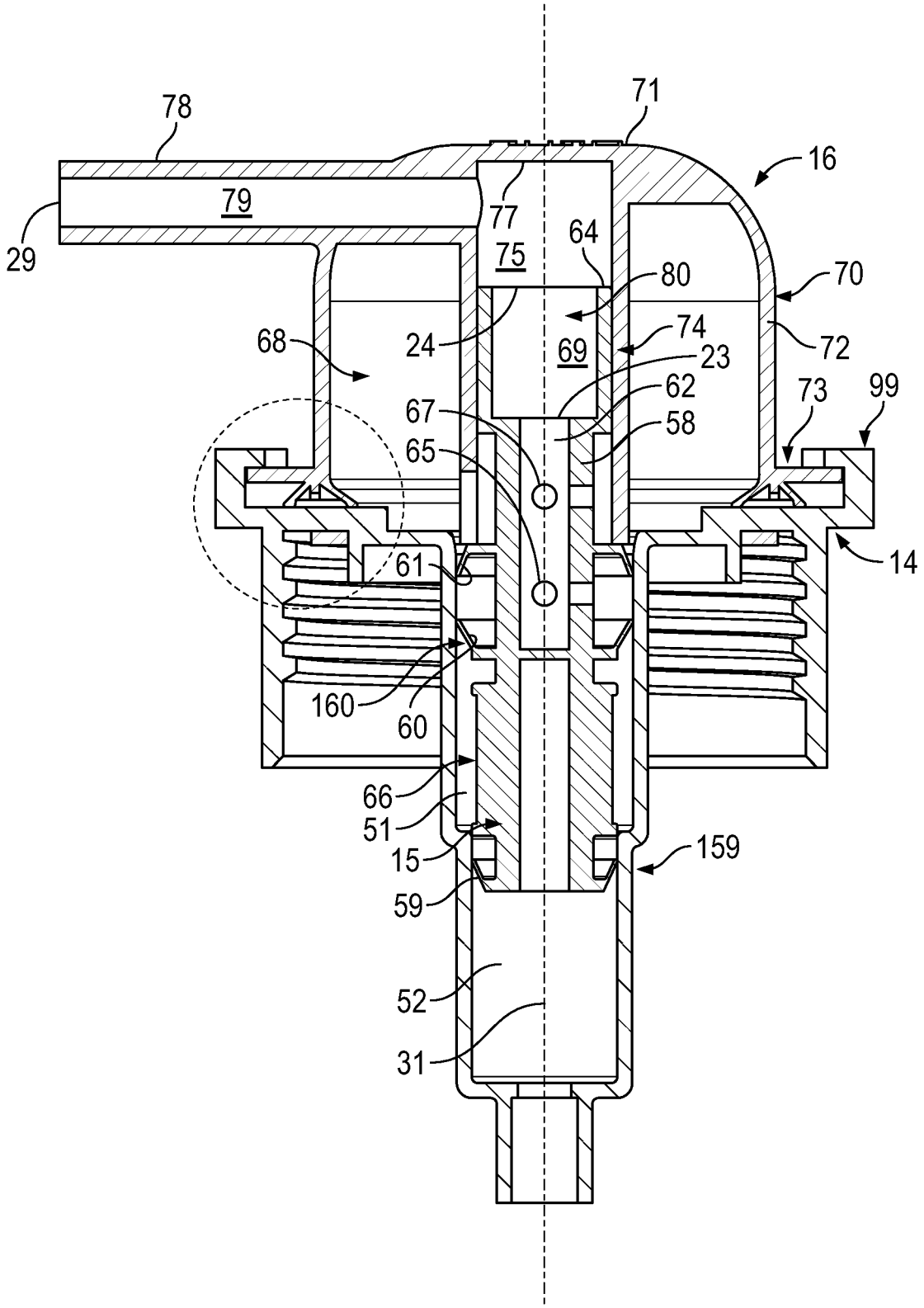
FIG. 5 is a cross-sectional side view of the pump assembly of FIG. 1 in an extended position.
Figure 6:
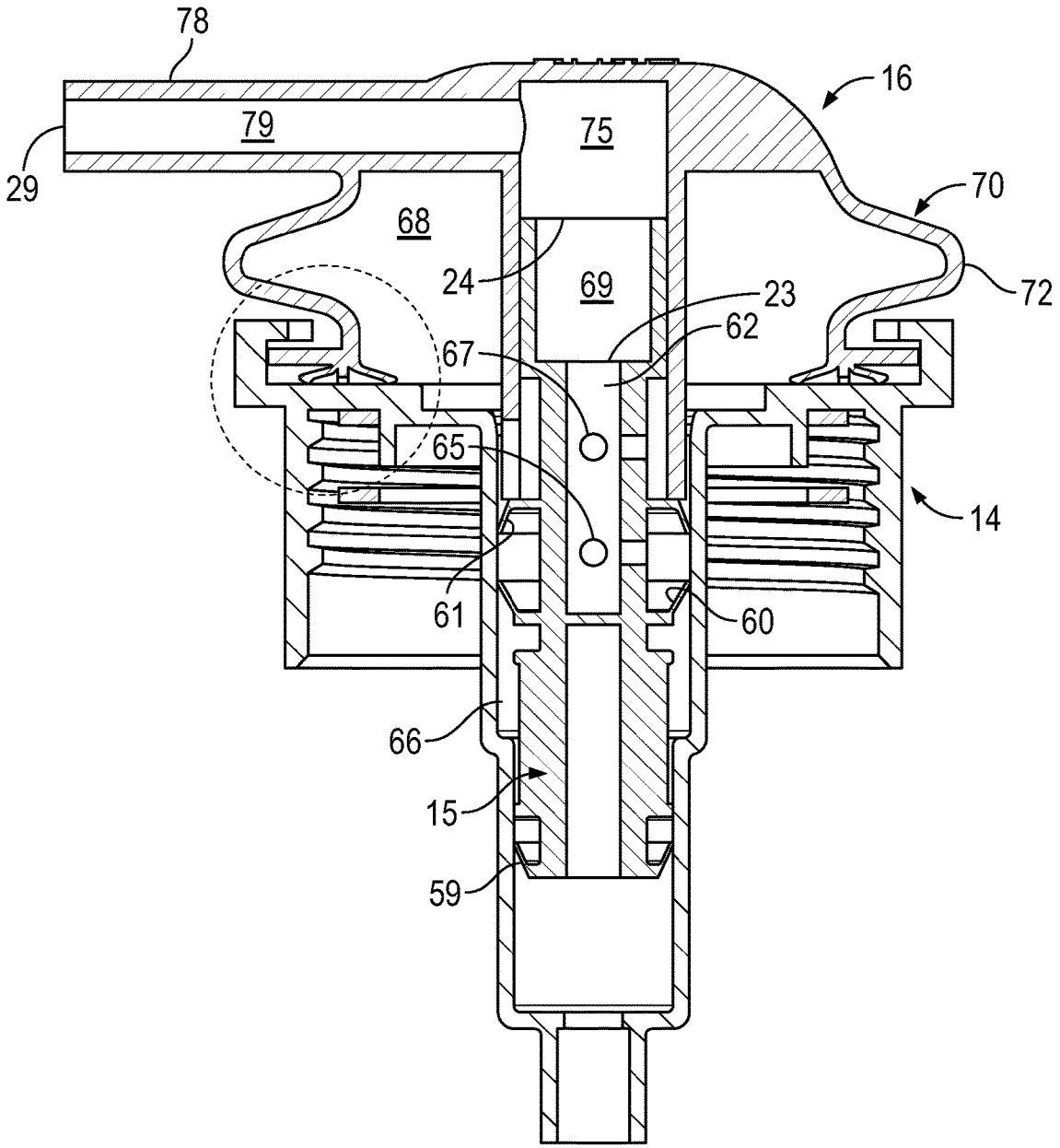
FIG. 6 is a cross-sectional side view the same as FIG. 5 but with the pump assembly of FIG. 1 in a retracted position.

The three major elements are assembled with the piston-forming element 15 affixed to the diaphragm-forming component 16 and with the piston-forming element 15 and the diaphragm-forming element 16 coupled to the piston chamber-forming body 14 for movement between an extended position as seen in FIG. 5 and a retracted position as seen in FIG. 6.

A liquid pump generally indicated 26 is formed by the interaction of the piston-forming element 15 and the piston chamber-forming body 14 and an air pump generally indicated 28 is formed notably by interaction of the diaphragm-forming component 16 and to the piston chamber-forming body 14. In moving from the extended position of FIG. 5 to the retracted position of FIG. 6, the liquid pump 26 discharges the liquid 13 from the reservoir 12 simultaneously with the air pump discharging air such that air and liquid may simultaneously be passed through a foam generator 80 including the foam generating screens 23 and 24 and out a dispensing or discharge outlet 29. Moving from the retracted position of FIG. 6 to the extended position of FIG. 5, atmospheric air is drawn in by the air pump 28. An air relief valve 30 is provided between the diaphragm-forming component 16 and the piston chamber-forming body 14 to permit atmospheric air to flow from the atmosphere into the interior 19 of the reservoir 12 to relieve any vacuum that may develop within the reservoir 12.

Figure 10:
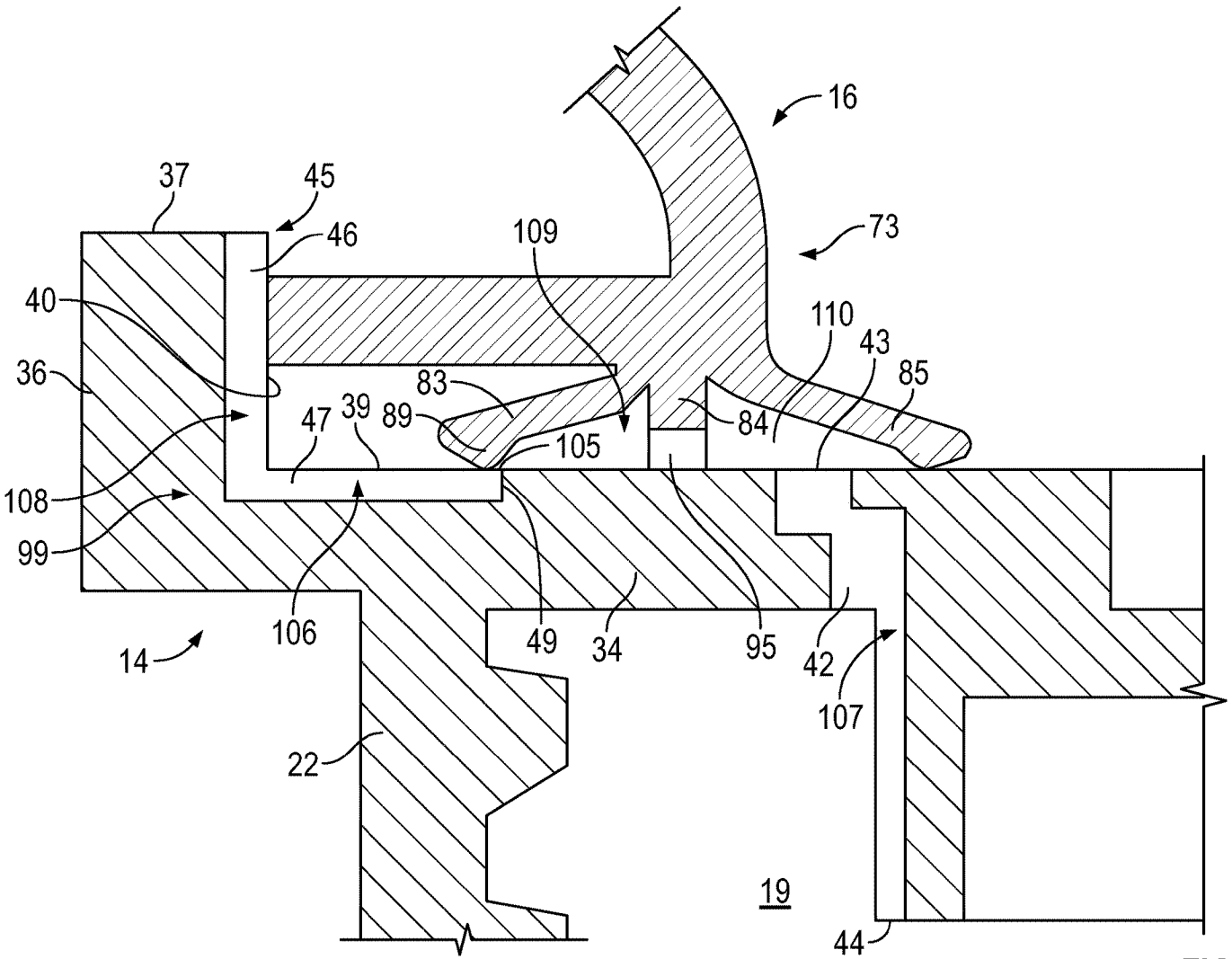
FIG. 10 is an enlarged cross-sectional view of FIG. 6 similar to FIG. 8 but along a vertical cross-section through FIG. 6 along radial vertical section line 9-9' on FIG. 3.

The piston chamber-forming body 14 is disposed about a central axis 31 and has an axially inner end 32 and an axially outer end 33. The piston chamber-forming body 14 includes a center tube 33 disposed coaxially about the axis 31 and open at both axial ends. The piston chamber-forming body 14 includes an annular bridge flange 34 which extends radially outwardly from the open upper end of the center tube 33. The threaded downwardly extending collar tube 22 extends downwardly from the annular bridge flange 34 coaxially about the center tube 33. The annular bridge flange 34 carries an outer tube 36 extending axially outwardly from the annular bridge flange 34 to an axial outer end of the outer tube 36 which carries a radially inwardly extending return flange 38 comprising circumferentially spaced segments. The bridge flange 34 provides a radially extending axially outwardly directed upper surface 39. The outer tube 36 provides a radially inwardly directed locating surface 40. The return flange 38 presents a radially extending axially inwardly directed stopping surface 41 opposed to the axially directed upper surface 39 and spaced axially a first distance D1 as best shown on FIG. 7. A plurality of vent passages 42 extend axially through the annular bridge flange 34 from a first opening 43 in the upper surface 39 to a lower opening. At similar circumferential locations to the vent passages 42, a number of vent channels 45 are provided, each formed by an axially extending radially inwardly open channelway 46 on the outer tube 36 and a radially extending axially outwardly open radial channelway 47 as seen in FIG. 10. The axial channelway 46 is open to the atmosphere at an outer end 37 of the outer tube 36 and communication is provided by the axial channelway 46 and the radial channelway 47 to a radial inner end 49 of the radial channelway 47.

Inside the center tube 33, a stepped fluid chamber 50 is defined having a cylindrical outer chamber 51 and a cylindrical inner chamber 52 with the diameter of the inner chamber 52 being less than the diameter of the outer chamber 51. Each chamber is coaxial about the axis 31. Each chamber has a cylindrical chamber wall, an inner end and an outer end. The outer end of the inner chamber 52 opens into the inner end of the outer chamber 51. An annular shoulder 53 closes the inner end of the inner chamber 51 about the outer end of the outer chamber 52. The inner chamber is open at an axial inner end 55 of the fluid chamber 50 into an axially inwardly opening socket 56 at the inner end 32 of the piston chamber-forming body 14 which socket 56 is adapted to secure an upper end of the dip tube 25 such that the dip tube 25 provides communication for fluid 13 from the bottom of the reservoir 12 into the inner chamber 52.

The piston-forming element 15 is coaxially slidably received within the piston chamber-forming body 14 providing the liquid pump 26 therebetween. The configuration of the liquid pump 26 has close similarities to a pump as disclosed in U.S. Pat. No. 5,975,360 to Ophardt, issued Nov. 2, 1999, the disclosure of which is incorporated herein by reference. The piston-forming element 15 has a central stem 58 from which there extends radially outwardly an annular inner disc 59, an annular intermediate disc 60 and an annular outer disc 61. The stem 58 defines internally an axially extending internal passageway 62 extending from an axially inner closed end 63 to an axially outer open end 64. Liquid ports 65 extends radially through the central stem 58 providing communication between the internal passageway 62 and the outer chamber 51 axially between the intermediate disc 60 and the outer disc 61.

The piston-forming element 15 is coaxially slidable relative to the piston chamber-forming body 14 between a retracted position as seen in FIG. 5 and an extended position as seen in FIG. 6. In a cycle of operation, the piston-forming element 15 is moved relative to the piston chamber-forming body 14 from the extended position to the retracted position in a retraction stroke and from the retracted position to the extended position in a withdrawal stroke. During a cycle of operation, the inner disc 59 is maintained within the inner chamber 52 and the intermediate disc 60 and the outer disc 61 are maintained within the outer chamber 51. The inner disc 59 with the inner chamber 51 form a first one-way liquid valve 159 permitting liquid flow merely outwardly therebetween. The inner disc 59 has an elastically deformable edge portion for engagement with the inner wall of the inner chamber 52. The inner disc 59 is biased outwardly into the wall of the inner chamber 52 to prevent fluid flow axially inwardly therepast, however, the inner disc 59 has its end portion deflect radially inwardly away from the wall of the inner chamber 52 to permit fluid flow axially outwardly therepast.

The outer disc 61 engages the side wall of the outer chamber 51 in a manner to substantially prevent fluid flow axially inwardly or outwardly therepast. The intermediate disc 60 has an elastically deformable edge portion which engages the side wall of the outer chamber 51 to substantially prevent fluid flow axially inwardly therepast yet to deflect away from the side wall of the outer chamber 51 to permit fluid to pass axially outwardly therepast. The outer disc 61 with the outer chamber 52 form a second one-way liquid valve 161 permitting liquid flow merely outwardly therebetween.

An annular fluid compartment 66 is defined in the fluid chamber 50 radially between the center tube 33 and the piston-forming element 15 axially between the inner disc 59 and the outer disc 61 with a volume that varies in a stroke of operation with axial movement of the piston-forming element 15 relative to the piston chamber-forming body 14. The fluid compartment 66 has a volume in the extended position greater than its volume in the retracted position. Operation of the liquid pump 26 is such that in a retraction stroke, the volume of the fluid compartment 66 decreases creating a pressure within the fluid compartment 66 which permits fluid flow radially outwardly past the inner disc 59 and axially outwardly past the intermediate disc 60 such that fluid is discharged axially outwardly past the intermediate disc 60 and via the liquid ports 65 into the internal passageway 62. In a withdrawal stroke, the volume of the liquid compartment 66 increases such that with the intermediate disc 60 preventing fluid flow axially outwardly therepast, the increasing volume in the liquid compartment 66 between the inner disc 59 and the intermediate disc 60 draws fluid from the reservoir 12 axially outwardly past the inner disc 59 from the reservoir 12.

The piston-forming element 15 includes on its central stem 58 axially outwardly from the outer disc 61 an air port 67 providing for communication from the internal passageway 62 to radially outwardly of the central stem 58 and into an air compartment 68 defined between the diaphragm-forming component 16 and the piston chamber-forming body 14. The internal passageway 62 within the central stem 58 includes proximate the outer open end 64 an enlarged foaming chamber 69. The inner screen 23 is secured to the central stem 58 to extend across the internal passageway 62 at an axially inner end of the foaming chamber 69 and the outer screen 24 is fixedly secured to the central stem 58 to extend across the internal passageway 62 at the outer open end 64.

The diaphragm-forming component 16 comprises a flexible annular diaphragm member 70 having at an axially outer end an end cap 71 and an annular flexible diaphragm side wall 72 that extends axially inwardly to an annular first end 73 of the diaphragm member 70. The diaphragm member 70 also includes a central tube 74 that extends coaxially about the axis 31. The annular first end 73 of the diaphragm member 70 engages on an annular seat arrangement 99 provided on the piston chamber-forming body 14 and formed by the annular bridge flange 34 with its upper surface 39, the outer tube 36 with its locating surface 40 and the return flange 38 with its axially inwardly directed stopping surface 41. The central tube 74 has a central bore 75 therein open axially inwardly at a bore inner end 76 and closed at a bore outer end 77.

The diaphragm member 70 includes a discharge tube 78 that extends radially outwardly on the end cap 71 defining therein a discharge passageway 79 and providing communication from the central bore 75 outwardly to the dispensing or discharge outlet 29 open to the atmosphere. A plurality of openings 81 are provided through the side wall 72 of the central tube 74 to provide communication radially through the central tube 74 proximate the bore inner end 76.

Figure 7:
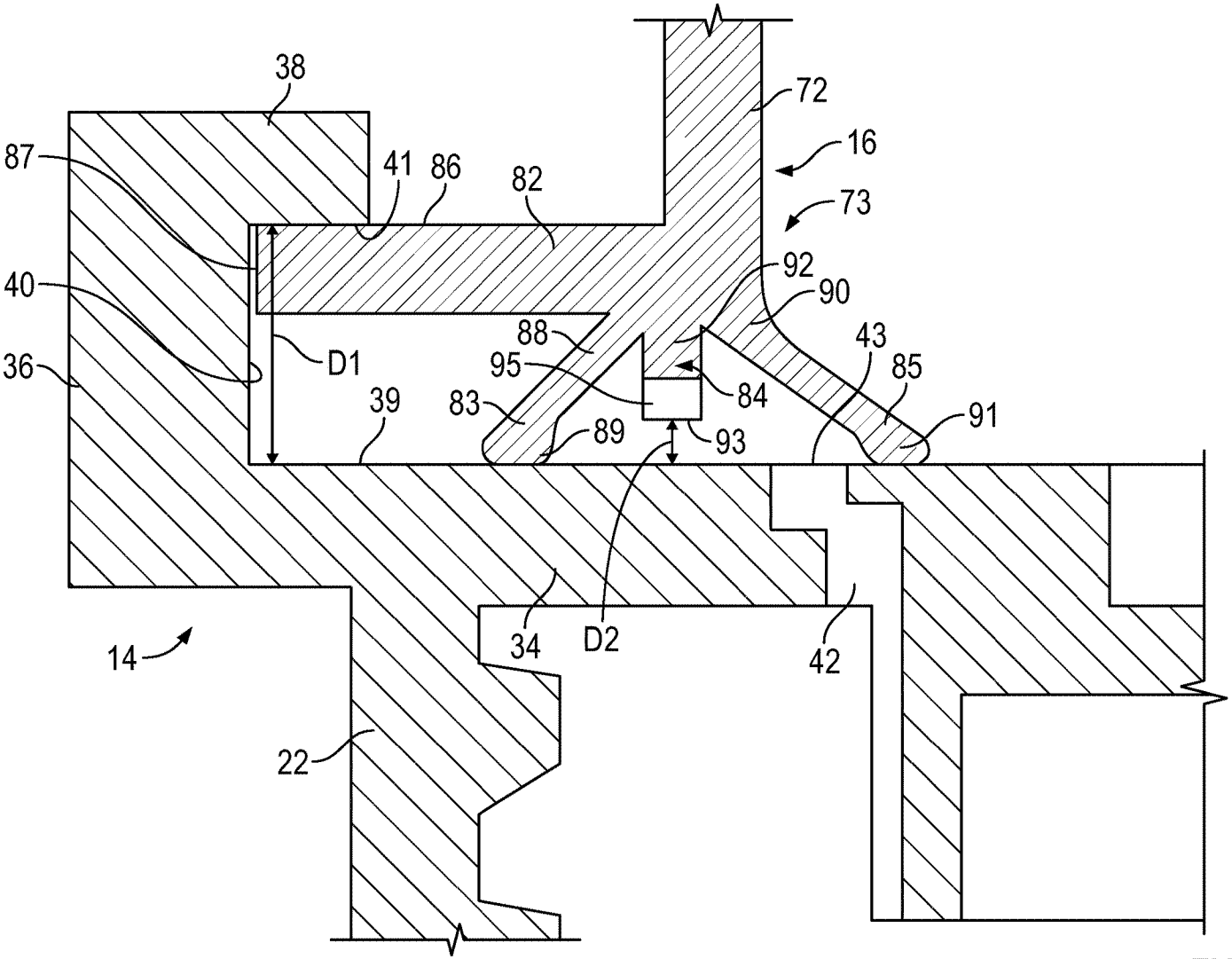
FIG. 7 is an enlarged cross-sectional view of FIG. 5 within an oval in dashed lines in FIG. 5.

As seen on FIG. 7, the annular first end 73 of the diaphragm member 70 includes a radially outwardly extending locating flange 82, an air relief valve member 83, a stop foot member 84 and a sealing member 85.

The piston-forming element 15 and the diaphragm-forming component 16 are fixedly secured together against removal under normal operation of the pump assembly 11 with a radially enlarged outer portion of the central stem 58 about the foaming chamber 69 received in a frictional force-fit relation within the central tube 74 and with the bore inner end 76 engaged on the outer disc 61 of the piston-forming element 15. With the piston-forming element 15 and the diaphragm-forming component 16 fixed together, the piston-forming element 15 is coaxially engaged within the fluid chamber 50 and the diaphragm-forming component 16 is engaged with the piston chamber-forming body 14 with the sealing member 85 and the air relief valve member 83 engaged on the upper surface 39 of the bridge flange 34 and the locating flange 82 disposed axially inwardly of the stopping surface 41 of the return flange 38 as best seen in the enlarged cross-sectional views of FIGS. 7 to 10. As seen in FIG. 7, the locating flange 82 includes an axially outwardly directed outer flange stop surface 86 opposed to and, in FIG. 7, engaging the stopping surface 41 on the return flange 38 of the piston chamber-forming body 14 to restrict actual outward movement of the annular first end 73 of the diaphragm member 70 relative to the piston chamber-forming body 14. The locating flange 82 is joined at a radially inner end to the diaphragm side wall 72 and extends radially outwardly as an annular flange to a radial distal end 87.

The air relief valve member 83 comprises an annular disc which extends from an axially outwardly and radially inwardly inner end 88 axially inwardly and radially outwardly to a distal end 89 in engagement with the upper surface 39 of the bridge flange 34.

The sealing member 85 extends from an axially outwardly and radially outwardly inner end 90 radially inwardly and axially inwardly to a distal end 91 in engagement with the upper surface 39 of the bridge flange 34.

The stop foot member 84 is provided in between the air relief valve member 83 and the sealing member 85 and extends axially inwardly from an axially outer end 92 to a foot stop surface 93 at a distal end.

As seen in FIG. 7, the foot stop surface 93 in the extended position of FIG. 7 is spaced axially outwardly from the upper surface 39 an axially a second distance D2, that is, less than the first distance D1. As seen in FIG. 7 and FIG. 4, at circumferentially spaced locations, a number of vent ports 95 are provided radially through the stop foot member 84 and provide for communication radially through the stop foot member 84.

The diaphragm-forming component 16 is preferably formed as an integral member from a resilient material having an inherent bias such that the diaphragm side wall 72 will assume an expanded inherent condition as shown in FIGS. 1 to 5. The side wall 72 is deflectable from the inherent condition with the inherent bias attempting to return the diaphragm side wall 72 to its inherent condition. The air pump 28 is formed with the annular diaphragm member 70 coaxially about the piston-forming element 15 spanning between an axial outer end 94 of the piston-forming element 15 and the piston chamber-forming body 14 to define the annular air compartment 68 therebetween having a variable volume. The diaphragm member 70 sealably engages with the piston-forming element 15 by reason of the axially outer end 64 of the central stem 58 being engaged within the central bore 75 of the center tube 74 of the diaphragm member 70 in a sealed and fixed manner.

With the piston-forming element 15 and the diaphragm-forming component 16 coupled to the piston chamber-forming body 14 as shown in FIGS. 5 and 6, the air compartment 68 is defined as an annular space axially between the end cap 71 of the diaphragm-forming component 16 and the bridge flange 34 of the piston chamber-forming body 14 and radially between the diaphragm side wall 72 and the central tube 74. The air compartment 68 is in communication with the internal passageway 62 via the air ports 67. The air compartment 68 has a volume which varies with displacement of the diaphragm member 70 between the extended position of FIG. 5 and the retracted position of FIG. 6.

Use of the foam dispenser 10 as shown in FIG. 1, with the reservoir 12 sitting a support surface 100, a user with one hand may apply downwardly directed force 101 onto the end cap 71 the diaphragm-forming component 16 as indicated by the schematic arrow so as to dispense fluid 13 mixed with air as a foam out of the discharge outlet 29 with the movement of the diaphragm-forming component 16 and the piston chamber-forming body 14 together relative to the piston chamber-forming body 14 from the extended position of FIG. 5 to the retracted position of FIG. 6. Under the application of the axially directed force 101, the diaphragm side wall 72 deflects from the expanded position of FIG. 5 to the compressed and deflated position in FIG. 6 and with such deflection of the annular side wall 72, the volume of the air compartment 68 reduces forcing air from the air compartment 68 through the air ports 67 into the internal passageway 62 of the central stem 58 and, hence, to the foam generator 80. Such discharge of air via the air pump 28 to the foam generator 80 is simultaneous with the discharge of the fluid 13 via the liquid pump 26 to the foam generator 80 such that the discharged liquid and air will simultaneously be passed through the foam generator 80 and, hence, via the central bore 75 and the discharge passageway 79 to discharge as foam out the discharge outlet 29. On release of the manually applied force 101, from the end cap 71, the inherent bias of the diaphragm side wall 72 urges the diaphragm side wall 72 to assume its inherent configuration as shown in FIG. 5 and, in doing so, diaphragm member 70 returns the piston-forming element 15 to the extended position as shown in FIG. 5. The inherent resiliency of the diaphragm side wall 72 acts, in effect, as a piston spring member to bias the piston-forming element 15 to the extended position of FIG. 5 relative to the piston chamber-forming body 14. In movement in the withdrawal stroke from the position of FIG. 6 to the position of FIG. 5, the volume of the air compartment 68 increases drawing atmospheric air into the air compartment 68 via the discharge outlet 29, the discharge passageway 79, the central bore 75, the internal passageway 62, the air port 67 and the openings 81.

Figure 8:
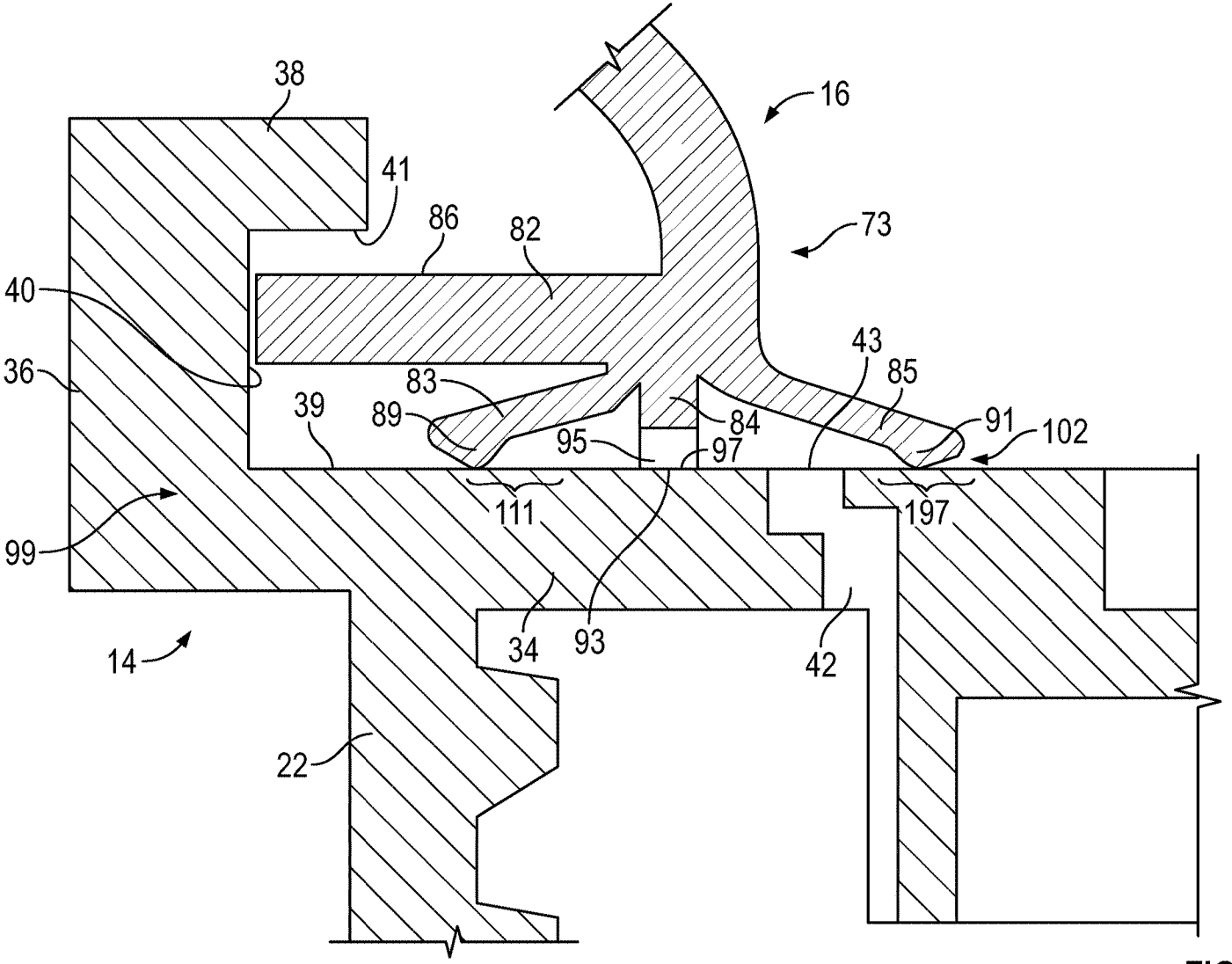
FIG. 8 is an enlarged cross-sectional view showing a portion of FIG. 6 within an oval in dashed lines in FIG. 6.

Referring to FIGS. 7 and 8, the annular first end 73 of the diaphragm member 70 engages with the annular seat arrangement 99 of the piston chamber-forming body 14 annularly about the piston chamber-forming body 14 for limited reciprocal axial movement of the first end 73 of the diaphragm member 70 relative the annular seat arrangement 99 between an axially outer position shown in FIG. 7 and an axially inner position shown in FIG. 8.

As can be seen in FIG. 7, the first end 73 of the diaphragm member 70 is engaged on the annular seat arrangement 99 of the piston chamber-forming body 14 with the locating flange 82 axially disposed between the bridge flange 34 and the return flange 38 with the axially outwardly directed outer flange stop surface 86 on the locating flange 82 in opposition to the axially inwardly directed stopping surface 41 on the return flange 38 so as to limit axial outward movement of the first end 73 of the diaphragm member 70 relative the annular seat arrangement 99 at the axially outer position as seen in FIG. 7. The stop foot member 84 has its axially inwardly directed foot stop surface 93 opposed to the upper surface 39 of the bridge flange 34 such that engagement between the foot stop surface 93 and the upper surface 39 of the bridge flange 34 limits axial inward movement of the first end 73 of the diaphragm member 70 in the axially inner position as shown in FIG. 8. An annular portion of the upper surface 39 of the bridge flange 34 where the annular foot stop member 84 engages is designated as and provides an axially inwardly directed stopping surface 97.

The first end 73 of the diaphragm member 70 includes the sealing member 85 which is an annular disc that extends axially inwardly and radially inwardly to the distal end 91 that is in sealed engagement with the upper surface 39 of the bridge flange 34 of the annular seat arrangement 99 of the piston-forming body 14 to form an annular seal 102 preventing flow between the sealing member 85 and the annular seat arrangement 99 in all positions of the first end 73 of the diaphragm member 70 and the annular seat arrangement 99 between the outer position of FIG. 7 and the inner position of FIG. 8. The sealing member 85 is formed of resilient material and has an inherent bias to adopt an inherent position and when deflected from the inherent position attempts to return to the inherent position. In moving from the axial outer position of FIG. 7 to the axially inner position of FIG. 8, the sealing member 85 is deflected and the distal end 91 displaced marginally radially inwardly on the upper surface 39 yet maintaining the annular seal 102 therewith to prevent fluid flow. The distal end 91 of the sealing member 85 engages the upper surface 39 to form the annular seal 102 therewith radially inwardly of the first opening 43 such that the annular seal 102 formed between the sealing member 85 and the upper surface 39 prevents flow into or out of the annular air compartment 68 between the first end 73 of the diaphragm member 70 and the annular seat arrangement 99 of the piston chamber-forming body 14. An annular portion of the upper surface 39 of the bridge flange 34 where the sealing member 85 engages is designated as and provides an axially inwardly directed sealing seat surface 197. In movement of the first end 73 of the diaphragm member 70 from the axially outer position of FIG. 7 to the axially inner position of FIG. 8, the sealing member 85 is deflected and the inherent bias of the sealing member 85 will attempt to remove the first end 73 of the diaphragm member 70 to the axially outer position of FIG. 7.

The first end 73 of the diaphragm member 70 carries the air relief valve member 83 which extends axially inwardly and radially outwardly to its distal end 89 which is in engagement with the upper surface 39 of the bridge flange 34. The air relief valve member 83 is resilient with an inherent bias to return to an inherent position and when deflected from the inherent position attempts to return to the inherent position. The distal end 89 of the air relief valve member 83 is in engagement with the upper surface 39 of the bridge flange 34 in all positions between the outer position of FIG. 7 and the inner position of FIG. 8. In axial movement of the outer end 73 of the diaphragm member 70 from the axial outer position of FIG. 7 to the axially inner position of FIG. 8, the distal end 89 of the air relief valve member 83 slides radially outwardly on the upper surface 39 as the air relief valve member 83 is deflected against its inherent bias. An annular portion of the upper surface 39 of the bridge flange 34 where the air relief valve member 83 engages is designated as and provides an axially inwardly directed annular air relief valve seat surface 111. The inherent bias of the air relief valve member 83 biases the first end 73 of the diaphragm member 70 from the axially inner position of FIG. 8 to the axially outer position of FIG. 7.

In use of the foam dispenser 10, when a user applies the downward force 101 to the end cap 71 as indicated by the schematic arrow in FIG. 1, the first end 73 of the diaphragm member 70 is moved from the axially outer position of FIG. 7 to the axially inner position of FIG. 8 during which movement each of the sealing member 85 and the air relief valve member 83 are deflected from their inherent position. On release of the downwardly directed force 101 onto the end cap 71, the inherent bias of each of the sealing member 85 and the air relief valve member 83 on the first end 73 of the diaphragm member 70 act on the annular seat arrangement 99 to bias the first end 73 of the diaphragm member 70 from the axial inner position of FIG. 8 to the axially outer position of FIG. 7. In this regard, each of the sealing member 85 and the air relief valve member 83, individually and collectively, act as a resilient positioning spring member to bias the first end 73 from the inner position towards the outer position.

Figure 9:
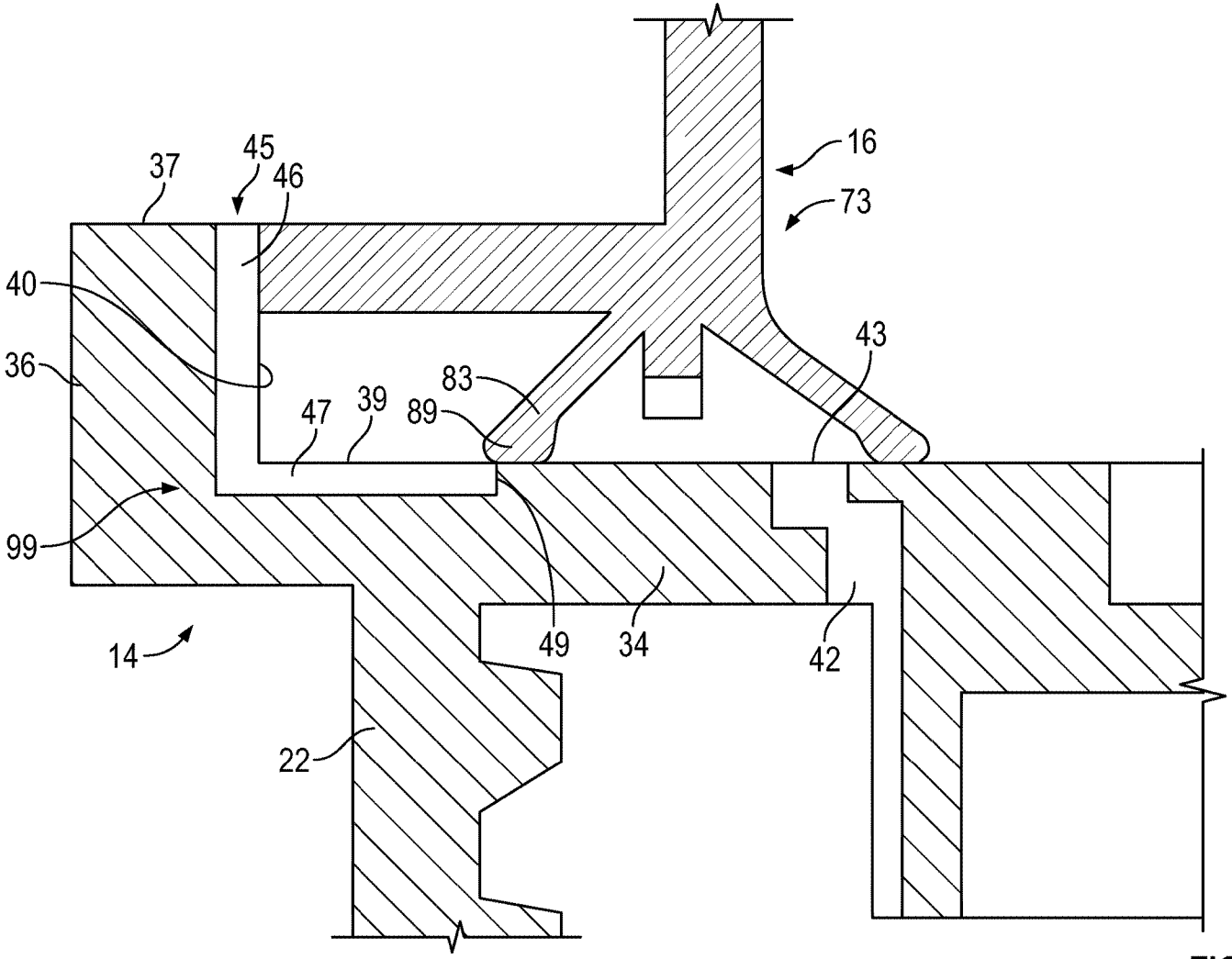
FIG. 9 is an enlarged cross-sectional view similar to FIG. 7 but along a vertical cross-section through FIG. 5 along the radial vertical section line 9-9' shown on FIG. 3.

Reference is made to FIGS. 9 and 10. FIG. 9 illustrates the first end 73 of the diaphragm member 70 engaged with the annular seat arrangement 99 of the piston chamber-forming body 14 in an axially outer position the same as that shown in FIG. 7, however, FIG. 9 illustrates a cross-section along a radially and axially extending plane indicated as 9-9' in FIG. 3 that includes the center axis 31 and passes through the bridge flange 34 through a vent channel 45 and a vent passage 42 and through a segment of the outer tube 36 where the return flange 38 is not provided.

FIG. 10 is a cross-sectional view the same as FIG. 9, however, showing the axially inner position as in FIG. 8.

Referring to FIG. 9 showing the axially outer position, the air relief valve member 83 has its distal end 89 engage the upper surface 39 radially inwardly of the radial inner end 49 of the radial channelway 47. On moving from the axially outer position of FIG. 9 to the axially inner position of FIG. 10, the distal end 89 of the air relief valve member 83 slides radially outwardly on the upper surface 39 so that a second opening 105 into the radial channelway 47 is provided radially inwardly of the distal end 89 and radially outwardly of the radially inwardly end 49 of the radial channelway 47.

As can be seen in FIG. 10, an air relief passageway generally indicated 106 is defined through the piston liquid chamber-forming body 14 providing communication between external atmospheric air and the interior 19 of the reservoir 12. The air relief passageway 106 includes an inner portion generally indicated 107 comprising the vent passage 42 providing communication from its lower opening end 44 through the piston chamber-forming body 14 to the first opening 43 on the upper surface 39 of the annular seat arrangement 99. The air relief passageway 106 includes an outer portion generally indicated 108 including the vent channel 45 with its axial channelway 46 and radial channelway 47 providing communication between external atmospheric air and the second opening 105 on the axially outwardly directed upper surface 39. The air relief passageway 106 further includes an intermediate portion generally indicated 109 between the first opening 43 and the second opening 105 which, as can be seen in FIG. 10, passes through an annular air relief compartment 110 formed between the sealing member 85 and the air relief valve member 83 and the upper surface 39 and including the vent port 95 through the stop foot member 84. The annular air relief compartment 110, as seen in FIG. 10, provides communication between the first opening 43 and the second opening 105. The air relief valve member 83 engages the air relief valve seat surface 111 to close and to open the air relief passageway 106 dependent upon the axial position of the first end 73 of the diaphragm member 70 relative the annular seat arrangement 99 between the axially inner position and the axially outer position.

As seen in FIG. 10 in the axial outer position, the air relief valve member 83 engages the air relief valve seat surface 111 of the upper surface 39 so as to open the air relief passageway 106 by providing the second opening 105. As seen in FIG. 9 in the axial outer position, the air relief valve member 83 has moved radially inwardly of the radial inner end 49 of the radial channelway 47 of the vent channel 45 and engages the air relief valve seat surface 111 of the upper surface 39 in a sealed manner so as to close the air relief passageway 106 by eliminating the second opening 105.

The interaction of the air relief valve member 83, the air relief valve seat surface 111 and the air relief passageway 106 forms the air relief valve 30 across the air relief passageway 106 that opens and closes the air relief passageway 106 dependent upon the relative axial position of the piston-forming member 15 and the liquid chamber-forming body 14. In the position of FIG. 5, the air relief valve 30 closes the air relief passageway 106 and thus encloses the interior 19 of the reservoir 12. In the axially inner position of FIG. 6, the air relief valve 30 opens the air relief passageway 106 so as to permit air from the atmosphere to flow into the interior 19 of the reservoir 12 as to relieve any vacuum condition which may have arisen in the interior 19 due to discharge of the liquid 13 from the reservoir 12 by the liquid pump 26.

Figure 11:
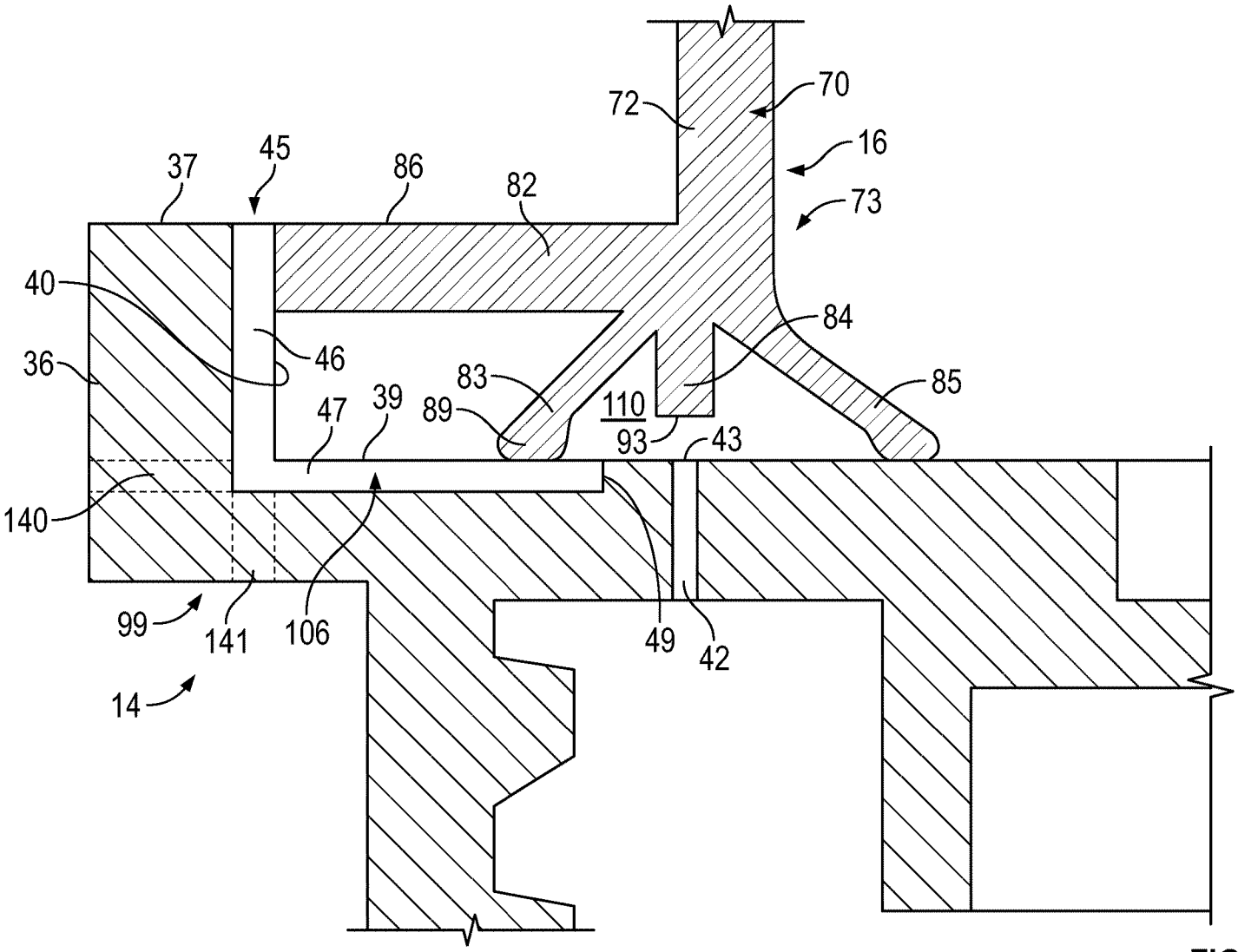
FIG. 11 is an enlarged cross-sectional view similar to FIG. 9 but showing a second embodiment of a foaming pump assembly in accordance with the present invention in an extended position similar to that shown in FIG. 9.
Figure 12:
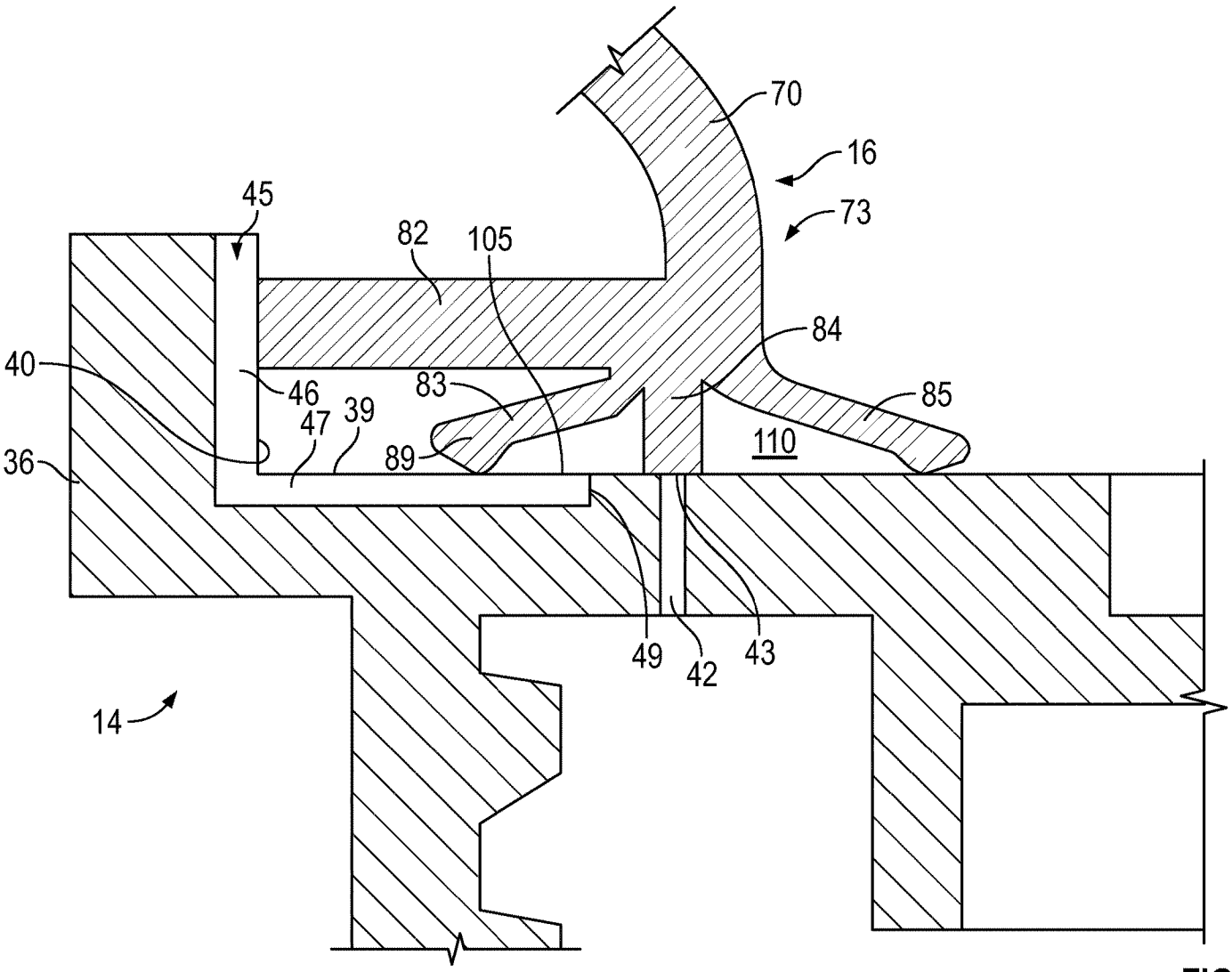
FIG. 12 is an enlarged cross-sectional view similar to FIG. 11 but showing the second embodiment of the foaming pump assembly of FIG. 11 in a retracted position similar to FIG. 10.

Reference is made to FIGS. 11 and 12 which illustrate a second embodiment of a foaming pump assembly in accordance with the present invention. The second embodiment is identical to the first embodiment other than in differences illustrated in FIGS. 11 and 12 as to the configuration of the first end 73 of the diaphragm member 70 and the annular seat arrangement 99 on the piston chamber-forming body 14.

In FIGS. 11 and 12, the first end 73 has a locating flange 82, an air relief valve member 83 and a sealing member 85 identical to those in the first embodiment, for example, as shown in FIGS. 9 and 10. In FIG. 11, a stop foot member 84 is provided which is modified over that of the first embodiment so as to eliminate the vent ports 95.

As seen in FIGS. 11 and 12, the vent passage 42 has been located with its first opening 43 axially in line with the annular stop foot member 84 such that on the foot stop surface 93 engaging the upper surface 39 of the bridge flange 34 in the axially inner position of FIG. 12, the stop foot member 84 closes the first opening 43 and thereby vent passage 42 against flow therethrough.

As seen in FIGS. 11 and 12, the vent channel 45 is provided similar to that shown in FIGS. 9 and 10 with an axial channelway 46 opening into a radial channelway 47, however, with the difference that the radial inner end 49 of the radial channelway 47 is radially inwardly of the distal end air relief valve member 83 at all times and thus, at all times, the second opening 105 is open into the annular air relief compartment 110. In the second embodiment of FIGS. 11 and 12, with the foaming pump assembly 11 in an extended position similar to that in FIG. 5, the air relief valve 30 is formed between the air relief valve member 83 and the annular seat arrangement 99 providing the air relief passageway 106 to be open permitting communication between the atmospheric air and the interior 19 of the reservoir 12. In a retracted position similar to that in FIG. 6, the air relief valve 30 closes the air relief passageway 106. Generally, the first embodiment is preferred such that when foaming pump assembly 11 is not being used, the air relief valve 30 assists in preventing fluid from the reservoir 12 to flow from the reservoir 12 should, for example, the reservoir 12 be tipped onto its side.

In accordance with the preferred embodiments, the major components of the pump assembly 11, namely, the piston chamber-forming body 14, the piston-forming element 15 and the diaphragm-forming component 16 are each formed as an integral element preferably by injection molding. This has the advantage of reducing the number of elements required as is of assistance in reducing the ultimate costs of manufacturing and assembling the resultant product. The diaphragm-forming component 16 in each of the preferred embodiments is preferably configured so as to facilitate injection molding of the diaphragm-forming component 16 as from a resilient preferably elastomeric matter. Particularly, the arrangement and relative location notably of the valve member 83 and the sealing member 85 provide for advantageous sealing engagement between each of the valve member 83 and the sealing member 85 with the annular seat arrangement 99 merely over axially directed surfaces.

It is not necessary but preferred that the diaphragm-forming component 16 may be formed as an integral element. It could be formed from a plurality of elements which are subsequently assembled. Each of the piston chamber-forming body 14 and the piston-forming element 15 which, while preferably are unitary elements, may each be formed from a plurality of elements.

The diaphragm-forming component 16 and its diaphragm member 70 preferably have sufficient resiliency that from an unassembled condition as illustrated, for example, in FIG. 3, the first end 73 of the diaphragm member 70 can be resiliently deformed so that the locating flange 82 may be manipulated to become engaged axially inwardly of the return flange 38. The engagement of the radial distal end 87 of the locating flange 82 with the locating surface 40 of the outer tube 36 of the piston chamber-forming body 14 can assist in preventing radially outward movement of the first end 73 of the diaphragm member 70 as during application of the force 101.

In the preferred embodiment, the piston chamber-forming body 14 is preferably formed from relatively rigid plastic material.

The return flange 38 is shown in the figures as being a number of circumferentially spaced segments on the outer tube 36 with portions of the outer tube 36 between the return flange segments where the vent channels 45 are provided. Providing the return flange 38 as circumferentially spaced segments can assist in manufacture of the piston chamber-forming body 14, however, is not necessary and the return flange 38 may extend circumferentially about the entirety of the outer tube 36.

In the preferred embodiments, the air vent channel 45 is illustrated as opening upwardly at its axially outer end to the atmosphere. This is not necessary. The air vent channel 45 may open to the atmosphere at different locations, for example, as to extend radially outwardly from the radial channelway 47 through the outer tube 36 to the atmosphere as shown in dashed lines as 140 on FIG. 11 or through the bridge flange 34 axially inwardly to the atmosphere as shown in dashed lines as 141 on FIG. 11.

The piston-forming element 15 is preferably shown as an integral element but for the provision of the two foaming screens 23 and 24. Each of the foam generating screens 23 and 24 provide small apertures which create turbulence on the simultaneous passage of liquid and air therethrough as is advantageous to provide for preferred foam of the fluid and air. The foaming screens 23 and 24 with the foaming chamber 69 provide the foam generator 80 which, in a known manner, provides with the simultaneous passage of the fluid and the air therethrough for the fluid 13 to be mixed with the air and form a foam. Various other foam generators may be used, some of which may be formed as integral elements of the piston-forming element 15 and/or diaphragm member 70 without the need for additional elements such as the screens.

The provision of the foam generator 80 is not necessary and, in another embodiment, the screens 23 and 24 may be eliminated and the fluid 13 and the air may be discharged from the discharge outlet 29 as a mixture of the fluid and air, possibly with a nozzle arrangement provided at or upstream of the discharge outlet 29 as to dispersing the liquid into droplets in the air as in a spray or a mist. If desired, arrangements can be provided to separate the fluid discharged from the air discharged until they are directed into the nozzle.

While the piston-forming element 15 is preferably formed as a unitary element from injection molding, this is not necessary and the piston-forming element may be formed from a plurality of elements. The liquid pump 26 is illustrated as comprising a stepped pump arrangement so as to minimize the number of components forming the liquid pump 26. Rather than provide the liquid pump 26 to be formed merely between the stepped fluid chamber 50 and the piston-forming element 15, a fluid chamber could be utilized having a constant diameter and a separate one-way inlet valve may be provided between this chamber and the reservoir as in a manner, for example, disclosed in the liquid pump of U.S. Pat. No. 7,337,930 to Ophardt et al, issued Mar. 4, 2008, the disclosure of which is incorporated herein by reference.

In the preferred embodiments, the diaphragm-forming component 16 is illustrated as including and formed with the discharge tube 78. This is a preferred arrangement for providing the pump assembly 11 to have the diaphragm-forming component 16 and the piston-forming element 15 each formed as a separate integral element and permitting the insertion of the screens 23 and 24 therebetween. In other arrangements, however, the discharge tube 78 may form part of the piston-forming element 15 extending radially from an upper end of the piston-forming element 15 and with the diaphragm-forming component 16 simplified so as to have the central bore 75 extend upwardly through the end cap 17 to an opening for annular engagement about the piston-forming element 15 axially inwardly from the radially outwardly extending discharge tube. Such a modified diaphragm-forming component would continue to have a flexible annular diaphragm member coaxially about the piston-forming element 15 spanning between an axial outer piston end of the piston-forming element 15 and the piston chamber-forming body 14 to define a variable volume annular air compartment therebetween.

In accordance with the present invention, it is preferred that the diaphragm member 70 be utilized in a position that the central axis 31 is generally vertical, however, this is not necessary and generally a principal requirement in any oriented use of the pump assembly 11 is that the fluid 13 in the reservoir 12 be at a height below the entranceway in the reservoir 12 to the air relief passageway 106. In one modification of the dispenser as illustrated in FIG. 1, the neck 21 on the reservoir 12 could be located proximate the upper end of the reservoir 12 albeit disposed about a horizontal axis in which case the axis 31 of the embodiment illustrated in FIG. 5 would be horizontal and the discharge outlet 29 would discharge fluid liquid downwardly. In another variant of such an arrangement, the discharge tube could be modified to be coaxial about the axis 31 and extend horizontally rather than downwardly.

While the invention has been described with reference to preferred embodiments, many modifications and variations will now occur to a person skilled in the art. For a definition of the invention, reference is made to the following claims.

We claim:

1. A pump having:

a liquid pump comprising a piston-forming element reciprocally axially slidable in a piston chamber-forming body between a retracted position and an extended position defining a liquid compartment therebetween having a variable volume;

an air pump comprising a flexible annular diaphragm member coaxially about the piston-forming element spanning between an axially outer piston end of the piston-forming element and the piston chamber-forming body to define a variable volume annular air compartment therebetween having a variable volume;

a non-collapsible reservoir having an interior containing a fluid to be dispensed, the interior enclosed but for having an outlet port, the piston chamber-forming body closing the outlet port, a liquid inlet through the piston chamber-forming body from the interior of the reservoir to the liquid pump, an air relief passageway through the piston chamber-forming body, the air relief passageway extending between an inlet opening on the piston chamber-forming body opening to the atmosphere and an outlet opening on the piston chamber-forming body opening into the interior of the reservoir, the air relief passageway providing communication between external atmospheric air and the interior of the reservoir through the piston chamber-forming body separate from the annular air compartment, in which:

(a) in the piston-forming element retracting in a retraction stroke to simultaneously force air from the air compartment and liquid from the liquid compartment internally through an internal passageway of the piston-forming element and deliver the air and liquid to a dispensing outlet carried on the piston forming element, and (b) in the piston-forming element extending in an extension stroke to simultaneously draw the atmospheric air into the air compartment and the liquid from the interior of the reservoir into the liquid compartment via the liquid inlet, the diaphragm member engaging the piston chamber-forming body to form therebetween an air relief valve across the air relief passageway to open and to close the air relief passageway dependent on the relative axial position of the piston-forming element and the piston chamber-forming body.

2. A pump as claimed in claim 1 wherein:

an annular first end of the diaphragm member engages with an annular seat arrangement of the piston chamber-forming body annularly about the piston-forming element for limited reciprocal axial movement of the first end of the diaphragm member relative the annular seat arrangement between an axially inner position and an axially outer position;

the first end of the diaphragm member having a resilient positioning spring member engaging with the annular seat arrangement of the piston chamber-forming body to bias the first end of the diaphragm member from the inner position toward the outer position;

the first end of the diaphragm member having a sealing member engaging the annular seat arrangement of the piston chamber-forming body to form an annular seal preventing flow into and out of the annular air compartment between the sealing member and the annular seat arrangement of the piston chamber-forming body in all positions of the first end of the diaphragm member and the annular seat arrangement between the inner position and the outer position, the annular seal preventing flow between the annular air compartment and the air relief passageway in all positions of the first end of the diaphragm member and the annular seat arrangement between the inner position and the outer position;

the first end of the diaphragm member having an air relief valve member interacting with an air relief valve seat surface of the annular seat arrangement of the piston chamber-forming body to close and to open the air relief passageway dependent on the axial position of the first end of the diaphragm member relative the annular seat arrangement between the inner position and the outer position.

3. A pump as claimed in claim 2 wherein the first end of the diaphragm member is an annular axially inner distal end of the diaphragm member.

4. A pump as claimed in claim 3 wherein in a first position selected from the inner position and the outer position, the air relief valve member engages the air relief valve seat surface of the annular seat arrangement of the piston chamber-forming body to close the air relief passageway and, in a second position, different than the first position and also selected from the inner position and the outer position, the air relief valve member is located relative the air relief valve seat surface of the annular seat arrangement of the piston chamber-forming body to open the air relief passageway.

5. A pump as claimed in claim 4 including a piston spring member biasing the piston-forming element to the extended position relative the piston chamber-forming body, and the diaphragm member deflectable between an expanded condition in which the piston-forming element is in the extended position relative the piston chamber-forming body and a compressed condition in which the piston-forming element is in the retracted position relative the piston chamber forming, the volume of the air compartment is greater when the diaphragm member is in the expanded condition than when the diaphragm member is in the compressed condition.

6. A pump as claimed in claim 5 wherein the diaphragm member having an inherent bias to assume the expanded condition and the inherent bias urges the diaphragm member to return toward the expanded condition when the diaphragm member is moved from the expanded condition toward the compressed condition.

7. A pump as claimed in claim 6 wherein the diaphragm member comprises the piston spring member.

8. A pump as claimed in claim 5 wherein the piston spring member biasing the piston-forming element to the extended position urges the first end of the diaphragm member toward the inner position and when the piston-forming element is in the extended position, the inherent bias of the positioning spring member moves the first end of the diaphragm member to the outer position.

9. A pump as claimed in claim 8 wherein the piston spring member urges the first end of the diaphragm member toward the inner position in opposition to the positioning spring member which urges the first end of the diaphragm member toward the outer position, and wherein when the piston-forming element is in the extended position, the positioning spring member overcomes the piston spring member and moves the first end of the diaphragm member to the outer position.

10. A pump as claimed in claim 7 wherein:

the diaphragm member having an annular flexible diaphragm side wall extending from a first side wall end at the first end of the diaphragm member to a second side wall end, the diaphragm side wall coaxially disposed about the piston-forming member with the second side wall end of the diaphragm side wall sealably coupled to the outer piston end of the piston-forming element for movement therewith and the first side wall end of the diaphragm side wall carrying the first end of the diaphragm member engaging the annular seat arrangement of the piston chamber-forming body to define the annular air compartment coaxially about the piston-forming element.

11. A pump as claimed in claim 10 wherein the diaphragm member has a central bore coaxially therethrough coaxially within the second side wall end of the diaphragm side wall, the outer piston end of the piston-forming element coaxially sealably engaged in the central bore.

12. A pump as claimed in claim 11 wherein the central bore having a bore inlet and a bore outlet leading to the dispensing outlet, the outer piston end of the piston-forming element coaxially sealably engaged in the central bore with the internal passageway opening into the central bore.

13. A pump as claimed in claim 12 wherein the pump other than the reservoir consists of:

a. the diaphragm member of elastomeric material formed integrally as a unitary integral element by injection molding, b. the piston chamber-forming body formed integrally as a unitary integral element by injection molding, and c. the piston-forming element formed integrally as a unitary integral element by injection molding.

14. A pump as claimed in claim 2 wherein:

the annular seat arrangement including an axially outwardly directed annular sealing seat surface, the sealing member comprising an annular sealing disc having an axially outer end fixed to the first end of the diaphragm member, the annular sealing disc extending axially inwardly from the axially outer end to an annular axially inner distal end of the annular sealing disc, the annular sealing disc being resilient and having an inherent bias urging the distal end of the annular sealing disc into sealed engagement with the axially outwardly directed annular sealing seat surface to form the annular seal preventing air flow between the sealing member and the axially outwardly directed annular sealing seat surface in all positions of the first end of the diaphragm member and the annular seat arrangement between the axially inner position and the axially outer position.

15. A pump as claimed in claim 14 wherein the annular seat arrangement including an axially outwardly directed stop surface and an axially inwardly directed stop surface are opposed to the axially outwardly directed stop surface and spaced axially from the axially outwardly directed stop surface a first axial distance, the first end of the diaphragm member having an axially outwardly directed stop surface opposed to the axially inwardly directed stop surface of the annular seat arrangement and an axially inwardly directed stop surface opposed to the axially outwardly directed stop surface of the annular seat arrangement and spaced axially from the axially outwardly directed stop surface of the annular seat arrangement a second distance less than the first axial distance, engagement between the axially outwardly directed stop surface on the annular seat arrangement and the axially inwardly directed stop surface on the first end of the diaphragm member limits movement of the first end of the diaphragm member relative the annular seat arrangement in the inner position; and engagement between the axially inwardly directed stop surface on the annular seat arrangement and the axially outwardly directed stop surface on the first end of the diaphragm member limits movement of the inner end of the diaphragm member relative the annular seat arrangement in the outer position.

16. A pump as claimed in claim 14 wherein:

the annular sealing disc extends radially inwardly as it extends axially inwardly from the axially outer end to an annular axially inner distal end, (i) in movement from the outer position to the inner position, the distal end of the annular sealing disc deflects radially inwardly against the inherent bias of the annular sealing disc with the annular axially inner distal end of the annular sealing disc sliding radially inwardly on the axially outwardly directed annular sealing seat surface in sealed engagement therewith, and (ii) in movement from the inner position to the outer position, urged by the inherent bias of the annular sealing disc, the distal end of the annular sealing disc deflects radially outwardly with the annular axially inner distal end of the annular sealing disc sliding radially outwardly on the axially outwardly directed annular sealing seat surface in sealed engagement therewith.

17. A pump as claimed in claim 16 wherein under the inherent bias of the annular sealing disc, the annular axially inner distal end of the annular sealing disc engages the axially outwardly directed annular sealing seat surface to urge the first end of the diaphragm member axially outwardly away from the axially outwardly directed annular sealing seat surface.

18. A pump as claimed in claim 2 wherein:

the air relief valve member comprising an annular valve disc having an axially outer end fixed to the first end of the diaphragm member, the annular valve disc extending axially inwardly from the axially outer end to an annular axially inner distal end of the annular valve disc, the annular valve disc extending radially outwardly as it extends axially inwardly, the air relief valve seat surface comprising an axially outwardly directed annular valve seat surface radially outwardly from the annular seal, (i) in movement from the outer position to the inner position, the distal end of the annular valve disc deflects against the inherent bias of the annular valve disc with the annular axially inner distal end of the annular valve disc sliding radially outwardly on the axially outwardly directed annular valve seat surface in sealed engagement therewith, and (ii) in movement from the inner position to the outer position, under the inherent bias of the annular valve disc, the distal end of the annular valve disc slides radially inwardly on the axially outwardly directed annular valve seat surface in sealed engagement therewith, the air relief passageway including:

(a) an inner portion through the piston liquid chamber-forming body providing communication from the interior of the reservoir to a first opening on the annular seat arrangement, (b) an outer portion providing communication between external atmospheric air and a second opening on the axially outwardly directed annular valve seat surface, and (c) an intermediate portion from the first opening to the second opening;

the first opening is radially outwardly of the annular seal and radially inwardly of the annular valve disc, in the outer position, the distal end of the annular valve disc is radially outwardly of the second opening and the sealed engagement of the distal end of the annular valve disc on the axially outwardly directed annular valve seat surface prevents communication through the intermediate portion between the first opening and the second opening, in the inner position, the distal end of the annular valve disc is radially inwardly of the second opening and the air is free to pass through the intermediate portion between the first opening to the second opening.

19. A pump as claimed in claim 18 wherein an annular air relief compartment is formed between the annular sealing disc and the annular valve disc enclosed but being open axially inwardly between the annular axially inner distal end of the annular valve disc and the annular axially inner distal end of the annular sealing disc, the annular seal preventing communication between the annular air compartment and the annular air relief compartment, the annular air relief compartment in communication with the first opening, in movement between the first position and the second position due to the radial sliding of the distal end of the annular valve disc movement to different radial positions on the axially outwardly directed annular valve seat surface, the annular air relief compartment is selectively placed into communication with the second opening and removed from communication with the second opening.

20. A pump as claimed in claim 2 wherein the annular seat arrangement including an axially outwardly directed stop surface and an axially inwardly directed stop surface are opposed to the axially outwardly directed stop surface and spaced axially from the axially outwardly directed stop surface a first axial distance, the first end of the diaphragm member having an axially outwardly directed stop surface opposed to the axially inwardly directed stop surface of the annular seat arrangement and an axially inwardly directed stop surface opposed to the axially outwardly directed stop surface of the annular seat arrangement and spaced axially from the axially outwardly directed stop surface of the annular seat arrangement a second distance less than the first axial distance, engagement between the axially outwardly directed stop surface on the annular seat arrangement and the axially inwardly directed stop surface on the first end of the diaphragm member limits movement of the first end of the diaphragm member relative the annular seat arrangement in the inner position; and engagement between the axially inwardly directed stop surface on the annular seat arrangement and the axially outwardly directed stop surface on the first end of the diaphragm member limits movement of the inner end of the diaphragm member relative the annular seat arrangement in the outer position.

21. A pump as claimed in claim 14 wherein:

the air relief valve member comprising an annular valve disc having an axially outer end fixed to the first end of the diaphragm member, the annular valve disc extending axially inwardly from the axially outer end to an annular axially inner distal end of the annular valve disc, the annular valve disc extending radially outwardly as it extends axially inwardly, the air relief valve seat surface comprising an axially outwardly directed annular valve seat surface radially outwardly from the axially outwardly directed annular seating seat surface, (i) in movement from the outer position to the inner position, the distal end of the annular valve disc deflects against the inherent bias of the annular valve disc with the annular axially inner distal end of the annular valve disc sliding radially outwardly on the axially outwardly directed annular valve seat surface in sealed engagement therewith, and (ii) in movement from the inner position to the outer position, under the inherent bias of the annular valve disc, the distal end of the annular valve disc slides radially inwardly on the axially outwardly directed annular valve seat surface in sealed engagement therewith, the air relief passageway including:

(a) an inner portion through the piston liquid chamber-forming body providing communication from the interior of the reservoir to a first opening on the annular seat arrangement, (b) an outer portion providing communication between external atmospheric air and a second opening on the axially outwardly directed annular valve seat surface, and (c) an intermediate portion from the first opening to the second opening;

the first opening is radially outwardly of the annular seal and radially inwardly of the annular valve disc, in the outer position, the distal end of the annular valve disc is radially outwardly of the second opening and the sealed engagement of the distal end of the annular valve disc on the axially outwardly directed annular valve seat surface prevents communication through the intermediate portion between the first opening and the second opening, in the inner position, the distal end of the annular valve disc is radially inwardly of the second opening and the air is free to pass through the intermediate portion between the first opening to the second opening.

22. A pump as claimed in claim 1 wherein:

an annular first end of the diaphragm member engages with an annular seat arrangement of the piston chamber-forming body annularly about the piston-forming element for limited reciprocal axial sliding movement of the first end of the diaphragm member relative the annular seat arrangement between an axially inner position and an axially outer position;

the first end of the diaphragm member having a resilient positioning spring member engaging with the annular seat arrangement of the piston chamber-forming body to bias the first end of the diaphragm member to slide axially from the inner position toward the outer position;

the first end of the diaphragm member having a sealing member engaging the annular seat arrangement of the piston chamber-forming body to form an annular seal preventing flow into and out of the annular air compartment between the sealing member and the annular seat arrangement of the piston chamber-forming body in all positions of the first end of the diaphragm member and the annular seat arrangement between the inner position and the outer position, the annular seal preventing flow between the annular air compartment and the air relief passageway in all positions of the first end of the diaphragm member and the annular seat arrangement between the inner position and the outer position;

the first end of the diaphragm member having an air relief valve member interacting with an air relief valve seat surface of the annular seat arrangement of the piston chamber-forming body to close and to open the air relief passageway dependent on the axial position of the first end of the diaphragm member relative the annular seat arrangement between the inner position and the outer position.

* * * * *